US005100771A

United States Patent [19]

Mihayashi et al.

[11] Patent Number: 5,100,771

[45] Date of Patent: Mar. 31, 1992

[54] SILVER HALIDE COLOR PHOTOGRAPHIC MATERIAL WITH WATER INSOLUBLE ORGANIC SOLVENT SOLUBLE POLYMER

[75] Inventors: Keiji Mihayashi; Hirohiko Kato; Hidetoshi Kobayashi, all of Kanagawa, Japan

[73] Assignee: Fuji Photo Film Co., Ltd., Kanagawa, Japan

[21] Appl. No.: 657,933

[22] Filed: Feb. 15, 1991

Related U.S. Application Data

[63] Continuation of Ser. No. 275,199, Nov. 23, 1988, abandoned.

[30] Foreign Application Priority Data

Nov. 27, 1987 [JP] Japan ..... 62-299311

[51] Int. Cl.[5] ..... G03C 7/36

[52] U.S. Cl. ..... 430/546; 430/545; 430/556; 430/557

[58] Field of Search ..... 430/545, 546, 556, 557, 430/505

[56] References Cited

U.S. PATENT DOCUMENTS

| | | | |
|---|---|---|---|
| 3,619,195 | 11/1971 | Van Campen | 430/545 |
| 4,120,725 | 10/1978 | Nakazyo et al. | 430/545 |
| 4,291,113 | 9/1981 | Minamizono et al. | 430/546 |
| 4,368,258 | 1/1983 | Fujihwhara et al. | 430/546 |
| 4,500,634 | 2/1985 | Sakanoue et al. | 430/557 |
| 4,770,985 | 9/1988 | Takada et al. | 430/557 |
| 4,791,050 | 12/1988 | Ogawa et al. | 430/557 |
| 5,001,045 | 3/1991 | Furutachi et al. | 430/545 |

FOREIGN PATENT DOCUMENTS 0134627 3/1979 Japan .

OTHER PUBLICATIONS

*Research Disclosure* No. 195 "Photographic Applications of Lattices", pp. 301-310, Jul. 1980.

Patent Abstracts of Japan, vol. 9, No. 30, (P-333)(1753) Feb. 8, 1985, abstracting JP-A-59-174839.

*Primary Examiner*—Richard L. Schilling

*Attorney, Agent, or Firm*—Sughrue, Mion, Zinn, Macpeak & Seas

[57] ABSTRACT

A silver halide color photographic material comprising a support having thereon at least one silver halide emulsion layer, wherein the silver halide color photographic material contains at least one water-insoluble and organic solvent soluble homopolymer or copolymer and at least one yellow coupler of the formula:

wherein $R_1$ represents a tertiary alkyl group or an aryl group; $R_2$ represents a hydrogen atom, a halogen atom or an alkoxy group; $R_3$ represents an alkyl group or an aryl group; and X represents a group capable of being released upon a coupling reaction with an oxidation product of an aromatic primary amine developing agent.

The silver halide color photographic material has high sensitivity and excellent sharpness, color reproducibility and preservability, before and after processing, as is free from sweating.

22 Claims, No Drawings

SILVER HALIDE COLOR PHOTOGRAPHIC MATERIAL WITH WATER INSOLUBLE ORGANIC SOLVENT SOLUBLE POLYMER

This is a continuation of application Ser. No. 07/275,199, filed Nov. 23, 1988, now abandoned.

FIELD OF THE INVENTION

The present invention relates to a silver halide color photographic material which has high sensitivity and improved sharpness, color reproducibility and preservability both before and after processing and is also free from sweating. The term "sweating" as used herein relates to a phenomenon wherein oily substances appear and aggregrate on the surface of photographic light-sensitive materials when the photographic light-sensitive materials are stored under conditions of high temperature and high humidity.

BACKGROUND OF THE INVENTION

Recent work in the field of silver halide color photographic materials has been directed at development of materials having super-high sensitivity as typically illustrated by ISO 1,600 films, with excellent image quality and sharpness suitable for use in small format cameras such as the 110 size cameras and disc cameras.

In order to improve sharpness, the thickness of the photographic light-sensitive material may be reduced resulting in a reduction of the optial scattering path during exposure and a reduction in the diffusion path of the oxidation product of developing agents formed at development. In order to reduce thickness, the amount of the binder employed such as gelatin must be decreased. However, when thickness is reduced in this manner, oil droplets tend to sweat on the surface or within other layers of the photographic material when stored under conditions of high temperature and high humidity before or after processing and images thus formed also fade, as described in JP-A-59-148052, and JP-A-59-149347 (the term "JP-A" as used herein means an "unexamined published Japanese patent application").

A method of reducing the thickness of an emulsion layer using .a polymer coupler instead of an oil-protected type coupler is described in JP-B-44-13375 (the term "JP-B" as used herein means an "examined Japanese patent publication"), JP-A-52-150631 and U.S. Pat. No. 3,370,952. However, the color forming property of a coupler is decreased by polymerization thus requiring an even thicker emulsion layer.

Moreover, in order to reduce molecular weight per color forming unit, yellow couplers having two to four color forming units per molecule are described in JP-A-53-82332, JP-A-54-133329, JP-A-55-2300 and JP-A-56-92539. However, these couplers also have low color forming properties.

SUMMARY OF THE INVENTION

Therefore, an object of the present invention is to provide a photographic light-sensitive material having remarkably improved sharpness and which is free from sweating.

Another object of the present invention is to provide a color photographic light-sensitive material having good color forming properties, high sensitivity and high gradation.

Other objects of the present invention will become apparent from the following detailed description and examples.

The objectives of the present invention are accomplished with a silver halide color photographic material comprising a support having thereon at least one silver halide emulsion layer, wherein the silver halide color photographic material contains at least one water-insoluble and organic solvent soluble homopolymer or copolymer and at least one yellow coupler represented by the general formula (I):

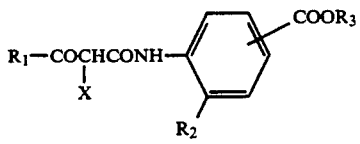

(I)

wherein $R_1$ represents a tertiary alkyl group or an aryl group; $R_2$ represents a hydrogen atom, a halogen atom or an alkoxy group; $R_3$ represents an alkyl group or an aryl group; and X represents a group capable of being released upon a coupling reaction with an oxidation product of an aromatic primary amine developing agent.

DETAILED DESCRIPTION OF THE INVENTION

The yellow couplers according to the present invention are described in JP-A-56-30126, JP-A-55-93153, JP-A-56-30127 and *Research Disclosure,* No. 18053. Photographic light-sensitive materials containing such yellow couplers have good color forming properties, high sensitivity and high gradation as well as excellent sharpness due to reduced thickness. However, these photographic materials exhibit considerable sweating of oil droplets when stored under conditions of high temperature and humidity. Image fading is also apt to occur.

As a result of extensive investigation, it has been found that a coupler having an ester group in its coupler skeleton according to the present invention has good color forming properties and can be used as a yellow coupler for the purpose of reducing the layer thickness. However, a photographic light-sensitive material containing this coupler is particularly disadvantageous in view of the sweating and image fading. Sweating and image fading are surprisingly eliminated and color reproducibility is improved when the yellow coupler is employed together with the polymer in accordance with the present invention.

The compounds represented by the general formula (I) are described in more detail below.

In the general formula (I), $R_1$ represents a tertiary alkyl group preferably having from 4 to 30 carbon atoms which may be substituted or an aryl group preferably having from 6 to 30 carbon atoms which may be substituted. Suitable examples of substituents for the substituted tertiary alkyl group represented by $R_1$ include a halogen atom (for example, fluorine, chlorine, bromine, iodine), an alkoxy group (for example, methoxy, ethoxy, methoxyethoxy, dodecyloxy), an aryloxy group (for example, phenoxy, p-methoxyphenoxy, p-dodecyloxyphenoxy, p-methoxycarbonylphenoxy, m-chlorophenoxy), an alkylthio group (for example, methylthio, ethylthio, benzylthio, dodecylthio), an arylthio group (for example, phenylthio, p-nitrophenylthio, p-dodecylphenylthio, p-tolylthio), a sulfonyl group (for example, methylsulfonyl, trifluoromethylsulfonyl, phenylsulfonyl, p-tolylsulfonyl), a sulfinyl group (for example, phenylsulfinyl, p-tolylsulfinyl, p-dodecylphenylsulfinyl), a cyano group, a thiocyanato group, a hydroxyl group, an imido group (for example, phthalimido, succinimido), and a heterocyclic group (for example, 1-pyrrolyl, 1-pyrazolyl, 1-imidazolyl, 1-benzimidazolyl, 3-hydantoinyl, morpholino, pyrrolidino, piperidino). Suitable examples of substituents for the substituted aryl group represented by $R_1$ include a halogen atom (for example, fluorine, chlorine, bromine, iodine), an alkyl group (for example, methyl, ethyl, isopropyl, sec-butyl, tertbutyl, cyclohexyl, allyl, tert-octyl, n-dodecyl, trifluoromethyl), an alkoxy group (for example, methoxy, ethoxy, methoxyethoxy, n-tetradecyloxy, benzyloxy), a nitro group, an amino group (for example, dimethylamino, diethylamino, pyrrolidyl), a carbonamido group (for example, acetamido, benzamido), and a sulfonamido group (for example, methylsulfonamido, phenylsulfonamido, dodecylsulfonamido).

Suitable examples of $R_1$ include a tert-butyl group, a 1,1-dimethylbutyl group, a 1-methyl-1-ethylpropyl group, a 1-methylcyclohexyl group, a 1-ethylcyclohexyl group, a 1-adamantyl group, a 2-chloro-1,1-dimethylethyl group, a 2-phenoxy-1,1-dimethylethyl group, a 2-phenylthio-1,1-dimethylethyl group, 2-(p-tolylsulfonyl)-1,1-dimethylethyl group, a phenyl group, a p-tolyl group, an o-tolyl group, a 4-chlorophenyl group, a 2-chlorophenyl group, a 4-nitrophenyl group, a 3-nitrophenyl group, a 4-methoxyphenyl group, a 2-methoxyphenyl group, a 4-ethoxyphenyl group, a 4-methoxy -3-[2-(2,4-di-tert-pentylphenoxy)-butanamido]-phenyl group, and a 4-methoxy-3-methylsulfonamidophenyl group.

In the general formula (I), $R_2$ represents a hydrogen atom, a halogen atom (for example, fluorine, chlorine, bromine, iodine) or an alkoxy group preferably having from 1 to 30 carbon atoms which may be substituted. Suitable examples of substituents for the substituted alkoxy group represented by $R_2$ include a halogen atom (for example, fluorine, chlorine, bromine, iodine), and an alkoxy group (for example, methoxy, ethoxy, methoxyethoxy, n-butoxy, n-hexyloxy, n-octyloxy, 2-ethylhexyloxy, n-dodecyloxy, n-tetradecyloxy, n-hexadecyloxy).

Suitable examples of $R_2$ include a methoxy group, an ethoxy group, a n-butoxy group, a methoxyethoxy group, and an n-tetradecyloxy group as well as a hydrogen atom and a halogen atom.

In the general formula (I), $R_3$ represents an alkyl group preferably having from 1 to 30 carbon atoms which may be substituted or an aryl group preferably having from 6 to 30 carbon atoms which may be substituted. Suitable examples of substituents for the substituted alkyl group represented by $R_3$ include a halogen atom (for example, fluorine, chlorine, bromine, iodine), a cyano group, a nitro group, an aryl group (for example, phenyl, p-tolyl, 2-methoxyphenyl), an alkoxy group (for example, methoxy, ethoxy, butoxy, benzyloxy, n-hexyloxy, 2-ethylhexyloxy, n-octyloxy, n-decyloxy, n-dodecyloxy, n-dodecyloxyethoxy, 2-(2,4-di-tert-pentylphenoxy)ethoxy), an alkoxycarbonyl group (for example, methoxycarbonyl, ethoxycarbonyl, n-butoxycarbonyl, n-dodecyloxycarbonyl), a carbamoyl group (for example, N,N-dimethylcarbamoyl, N-methyl-N-octadecylcarbamoyl, N-dodecyl-N-phenylcarbamoyl), an aryloxy group (for example, phenoxy, p-dodecyloxyphenoxy, 2,4-di-tert-pentylphenoxy, p-tert-octylphenoxy), as well as the alkylthio group, arylthio .group, sulfonyl group, sulfinyl group, imido group and heterocyclic group as described for the tertiary alkyl group represented by $R_1$. Suitable examples of substituents for the substituted aryl group represented by $R_3$ include a halogen atom (for example, fluorine, chlorine, bromine, iodine), an alkyl group (for example, methyl, ethyl, isopropyl, allyl, benzyl, tert-butyl, sec-butyl, cyclopentyl, cyclohexyl, tert-octyl, n-decyl, n-dodecyl), an aryl group (for example, phenyl, p-tolyl), an alkoxy group (for example, methoxy, ethoxy, n-dodecyloxy), and an alkoxycarbonyl group (for example, methoxycarbonyl, ethoxycarbonyl, n-dodecyloxycarbonyl).

Suitable examples of $R_3$ include a methyl group, an ethyl group, an n-butyl group, an n-hexyl group, an n-octyl group, a 2-ethylhexyl group, an n-decyl group, an n-dodecyl group, an n-tetradecyl group, an oleyl group, an n-hexadecyl group, an n-octadecyl group, a benzyl group, a cyclohexyl group, an allyl group, a propargyl group, a phenethyl group, a methoxyethoxy group, a phenoxyethoxy group, an n-dodecyloxyethyl group, an n-dodecyloxypropyl group, an n-dodecyloxyethoxyethyl group, a 2-(2,4-di-tert-pentylphenoxy)ethyl group, a 1-ethoxycarbonylethyl group, a 1-dodecyloxycarbonylethyl group, a 1-dodecyloxycarbonylpentyl group, a 1-(N-dodecyl-N-phenylcarbamoyl-)ethyl group, a pheny group, a 2,4-di-tert-pentylphenyl group, a p-tert-butylpheny group, a p-tert-octylphenyl group, a p-dodecylphenyl group, a p-dodecyloxyphenyl group, and a p-decyloxycarbonylphenyl group.

In the general formula (I), X represents a group capable of being released upon a coupling reaction with an oxidation product of an aromatic primary amine developing agent. Suitable examples of the group represented by X include a halogen atom (for example, fluorine, chlorine, bromine), a sulfonyloxy group having from 1 to 30 carbon atoms (for example, methylsulfonyloxy, phenylsulfonyloxy, p-tolylsulfonyloxy), an acyloxy group having from 2 to 30 carbon atoms (for example, acetoxy, benzoyloxy), an alkoxycarbonyloxy group having from 2 to 30 carbon atoms (for example, methoxycarbonyloxy, ethoxycarbonyloxy), a carbamoyloxy group having from 1 to 30 carbon atoms (for example, N,N-dimethylcarbamoyloxy, N-butylcarbamoyloxy, N-phenylcarbamoyloxy, N-dodecylcarbamoyloxy), an alkylthiocarbonyloxy group having from 2 to 30 carbon atoms (for example, methylthiocarbonyloxy, dodecylthiocarbonyloxy), a heterocyclic oxy group having from 1 to 30 carbon atoms (for example, 3-pyridyloxy, tetrazol-5-yloxy, oxazol-2-yloxy, thiazol-2-yloxy, 4-H-pyran-4-on-3-yloxy, 4-H-thiopyran-4-on-3-yloxy, benzoxazol-2-yloxy), a phenoxy group having from 6 to 30 carbon atoms which may be substituted and a heterocyclic group having from 1 to 30 carbon atoms which is connected to the coupling active position by the nitrogen atom included therein and which may be substituted.

Suitable examples of substituents for the phenoxy group represented by X include a halogen atom (for example, fluorine, chlorine, bromine, iodine), a hydroxyl group, a nitro group, a cyano group, a carboxyl group, a sulfo group, a carboxylato group, a sulfonato group, a sulfinato group, an alkyl group (for example, methyl, -ethyl, n-decyl, tert-butyl, trifluoromethyl, carboxymethyl), an alkoxy group (for example, methoxy, ethoxy, methoxyethoxy), an acyl group (for example, acetyl, benzoyl), an alkoxycarbonyl group (for example, methoxycarbonyl, ethoxycarbonyl, isopropoxycarbonyl, n-dodecyloxycarbonyl), a carbamoyl group (for example, N,N-dimethylcarbamoyl, N-methoxyethylcarbamoyl, N-tetradecylcarbamoyl), a sulfonyl group (for example, methylsulfonyl, phenylsulfonyl, 4-hydroxyphenylsulfonyl), a sulfamoyl group (for example, N-methylsulfamoyl, N-phenylsulfamoyl, N-dodecylsulfamoyl), a carbonamido group (for example, acetamido, benzamido, trifluoroacetamido, pentafluorobenzamido), a sulfonamido group (for example, methylsulfonamido, p-tolylsulfonamido), and an amino group (for example, amino, N,N-dimethylamino, N,N-diethylamino, pyrrolidino, piperidino).

Suitable examples of the phenoxy group represented by X include a phenoxy group, a 4-methoxyphenoxy group, a 4-nitrophenoxy group, a 4-carboxyphenoxy group, a 4-methoxycarbonylphenoxy group, a 4-methylsulfonylphenoxy group, a 4-acetamidophenoxy group, a 4-(3-carboxypropanamido)phenoxy group, a 4-chlorophenoxy group, a 3-hydroxy-4-methylsulfonylphenoxy group, a 4-cyanophenoxy group, a 2-methylsulfonamidophenoxy group, a 2-acetamido-4-methoxycarbonylphenoxy group, a 4-cyano -2-methylsulfonamidophenoxy group, a 4-(4-hydroxyphenylsulfonyl)phenoxy group, a 2-chloro-4-(3-chloro-4-hydroxyphenylsulfonyl)phenoxy group, a 4-isopropoxyphenoxy group, a 2-acetamido-4-carboxyphenoxy group, and a 4-sulfonatophenoxy group.

The heterocyclic group which is connected to the coupling active position by the nitrogen atom represented by X is preferably a 5- to 7-membered heterocyclic group which may be monocyclic or condensed and may be substituted. Suitable examples of the heterocyclic ring include succinimide, maleinimide, phthalimide, diglycolimide, pyrrole, pyrazole, imidazole, 1,2,4-triazole, tetrazole, indole, benzopyrazole, benzimidazole, benzotriazole, imidazolidine-2,4-dione, oxazolidine-2,4-dione, thiazolidine-2,4-dione, imidazolin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-l,3,4-thiazolidine, and 2-imino-l,3,4-thiazolidin-4-one. Suitable examples of substituents for the heterocyclic group include those described for the phenoxy group represented by X above.

Examples of preferred substituents represented by $R_1$, $R_2$, $R_3$ and X in the general formula (I) which can be used in the present invention are illustrated below.

$R_1$ is preferably a tert-butyl group, a phenyl group or a phenyl group substituted with a chlorine atom, a methyl group or a methoxy group. More preferably, $R_1$ is a tert-butyl group, a phenyl group or a 4-methoxyphenyl group.

$R_2$ is preferably a chlorine atom or an alkoxy group having from 1 to 8 carbon atoms. More preferably, $R_2$ is a chlorine atom or a methoxy group, and most preferably a chlorine atom.

$R_3$ is preferably an alkyl group, and more preferably an alkyl group having from 6 to 24 carbon atoms. The alkyl group may or may not be substituted. Preferred examples of the substituents for the alkyl group include an alkoxycarbonyl group and an alkoxy group. Preferred examples of the alkyl group for $R_3$ include an n-hexyl group, an n-octyl group, a 2-ethylhexyl group, an n-decyl group, an n-dodecyl group, an n-tetradecyl group, an n-hexadecyl group, a 2-hexyldecyl group, an n-octadecyl group, a 1-octyloxycarbonylethyl group, a 1-decyloxycarbonylethyl group, a 1-dodecyloxycarbonylethyl group and a 1-dodecyloxycarbonylpentyl group.

The $-COOR_3$ group may be present at any position on the benzene ring, but is preferably present at the para position to $R_2$.

X is preferably a phenoxy group or a heterocyclic group connected to the coupling active position by the nitrogen atom contained therein, and more preferably a group represented by the following general formula (II):

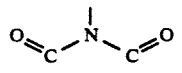

Z wherein Z represents

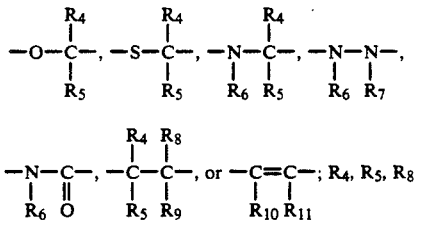

and $R_9$ each represents a hydrogen atom, an alkyl group, an aryl group, an alkoxy group, an aryloxy group, an alkylthio group, an arylthio group, an alkylsulfonyl group, an arylsulfonyl group or an amino group; $R_6$ and $R_7$ each represents a halogen atom, an alkyl group, an aryl group, an alkylsulfonyl group, an arylsulfonyl group or an alkoxycarbonyl group; $R_{10}$ and $R_{11}$ each represents a hydrogen atom, an alkyl group or an aryl group, or $R_{10}$ and $R_{11}$ may combine with each other to form a benzene ring; and $R_4$ and $R_5$, $R_5$ and $R_6$, $R_6$ and $R_7$ or $R_4$ and $R_8$ may combine with each other to form a ring (for example, a cyclobutane ring, a cyclohexane ring, a cycloheptane ring, a cyclohexene ring, a pyrrolidine ring, a piperidine ring).

Of the heterocyclic groups represented by the general formula (II), those represented by the general formula (II) wherein Z is

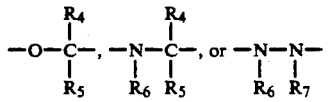

are preferred.

The total number of carbon atoms included in the heterocyclic group represented by the general formula (II) is generally from 2 to 30, preferably from 4 to 20 and more preferably from 5 to 16.

Suitable examples of the heterocyclic group represented by the general formula (II) include a succinimido group, a maleinimido group, a phthalimido group, a 1-methylimidazolidine-2,4-dion-3-yl group, a 1-benzylimidazolidine-2,4-dion-3-yl group, a 5,5-dimethyloxazolidine-2,4-dion-3-yl group, a 5-methyl-5-propyloxazolidine-2,4-dion-3-yl group, a 5,5-dimethylthiazolidine-2,4-dion-3-yl group, a 5,5-dimethylimidazolidine-2,4-dion-3-yl group, a 3-methylimidazolidinetrion-1-yl group, a 1,2,4-triazolidine-3,5-dion-4-yl group, a 1-methyl-2-phenyl-1,2,4-triazolidine-3,5-dion-4-yl group, a 1-benzyl-2-phenyl-1,2,4-triazolidine-3,5-dion-4-yl group, a 5-hexyloxy-1-methylimidazolidine-2,4-dion-3-yl group, a 1-benzyl-5-ethoxyimidazolidine-2,4-dion-3-yl group, and a 1-benzyl-5-dodecyloxyimidazolidine-2,4-dion-3-yl group.

Specific examples of the compound represented by the general formula (I) are set forth below, but the present invention should not be construed as being limited thereto.

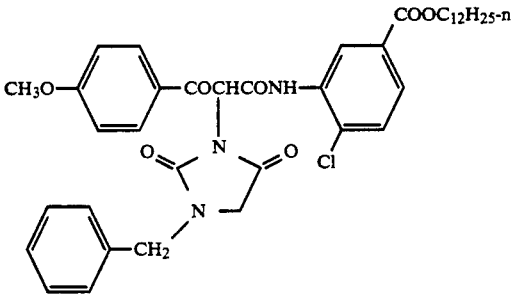

(Y-1)

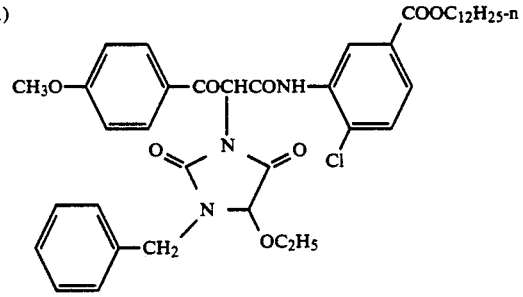

(Y-2)

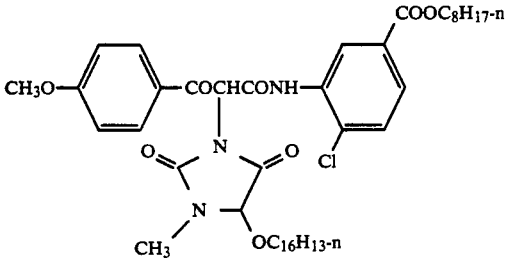

(Y-3)

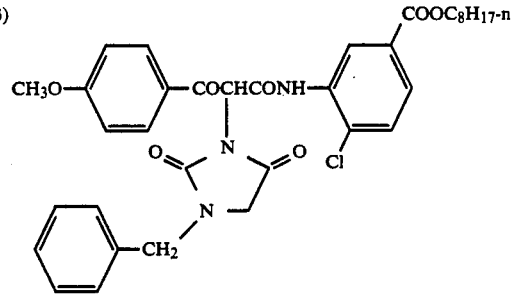

(Y-4)

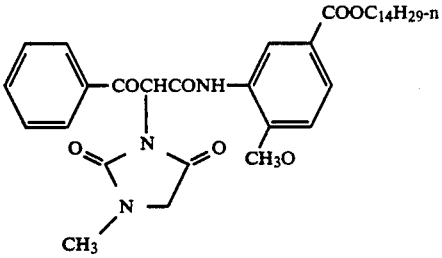

(Y-5)

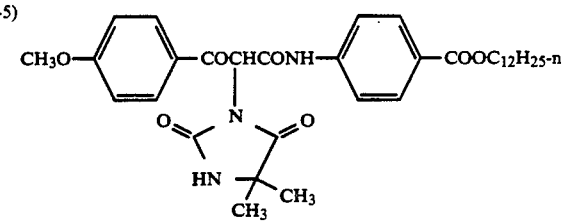

(Y-6)

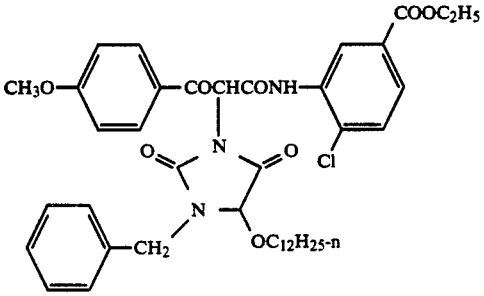

(Y-7)

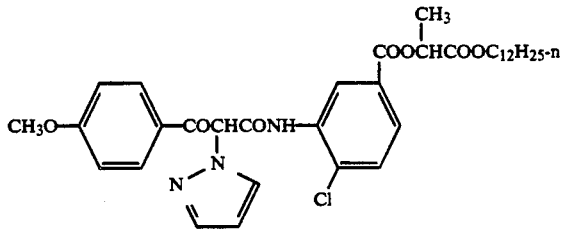

(Y-8)

-continued
(Y-9)
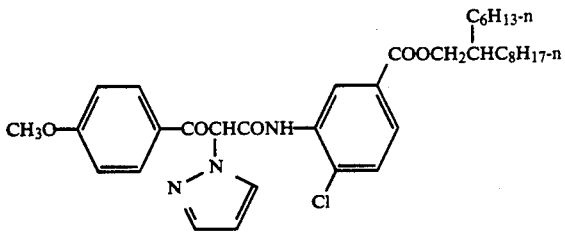
(Y-10)
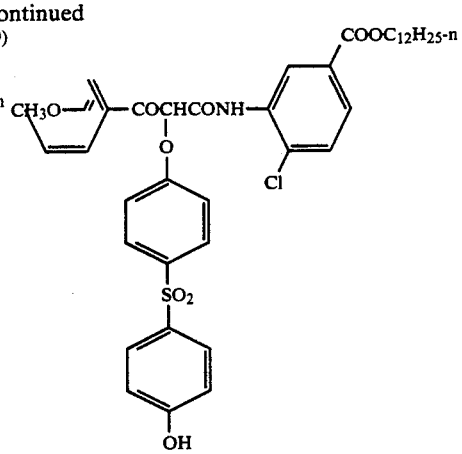
(Y-11)
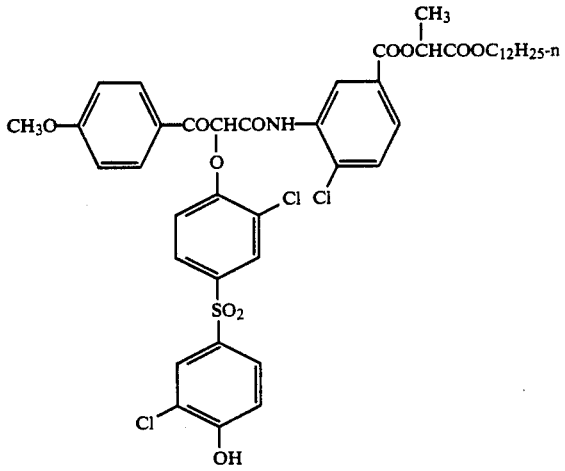
(Y-12)
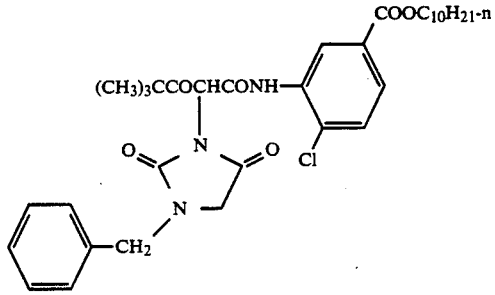
(Y-13)
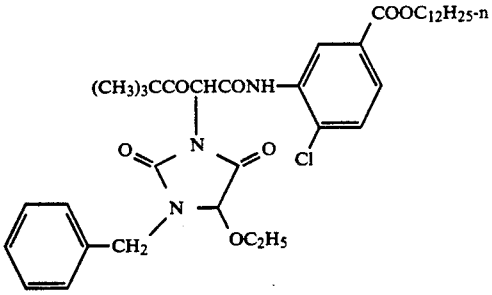
(Y-14)
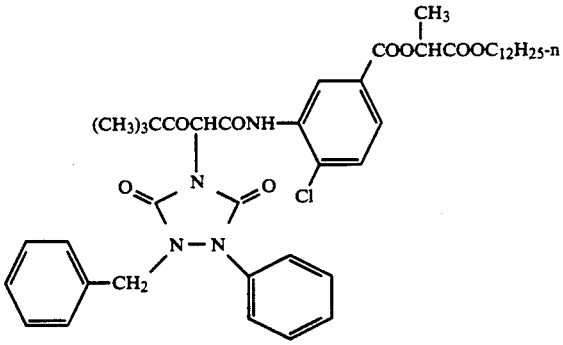
(Y-15)
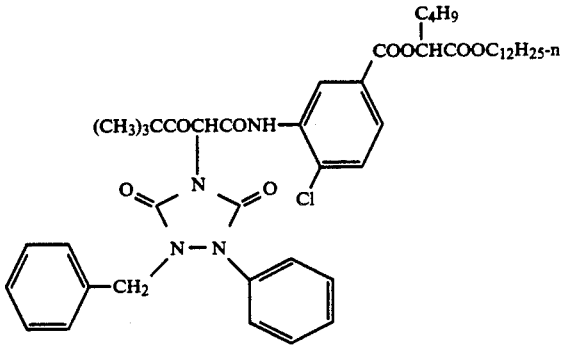
(Y-16)
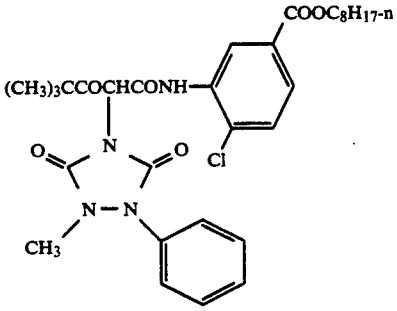

-continued
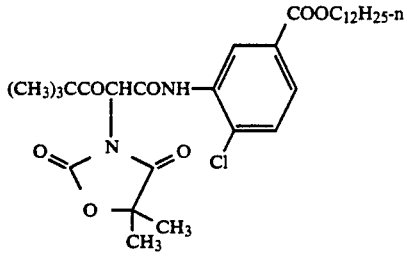
(Y-17)
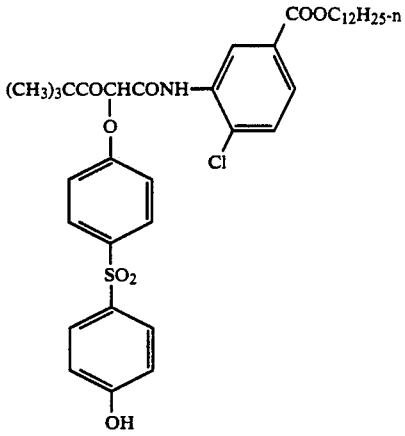
(Y-18)
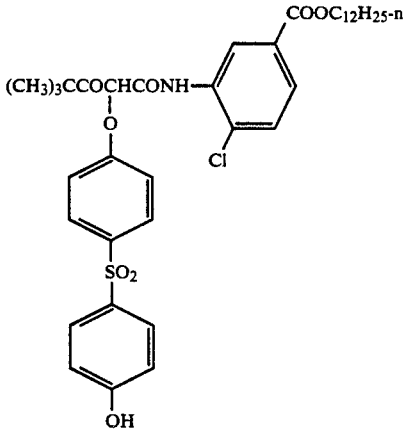
(Y-19)
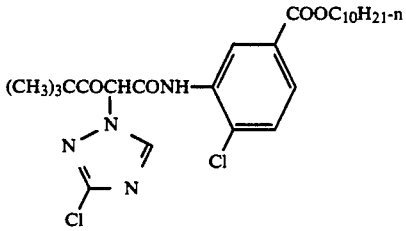
(Y-20)
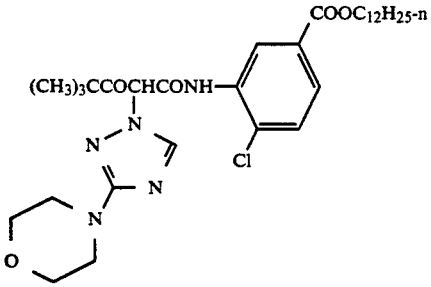
(Y-21)
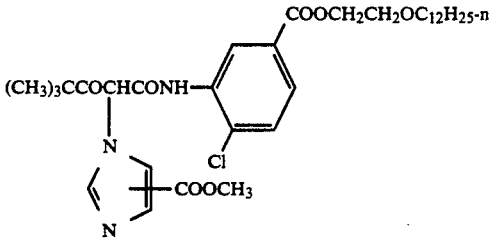
(Y-22)
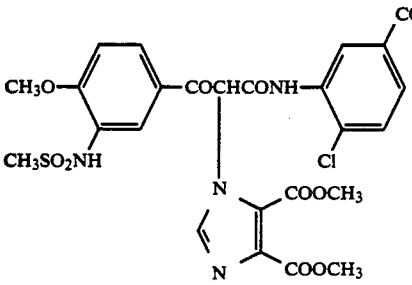
(Y-23)
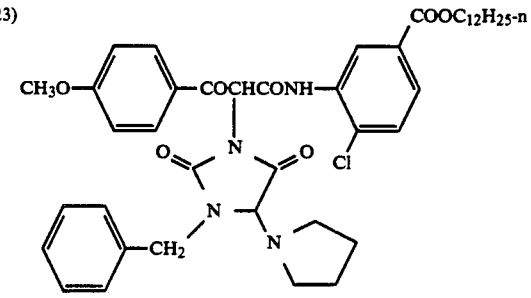
(Y-24)

-continued
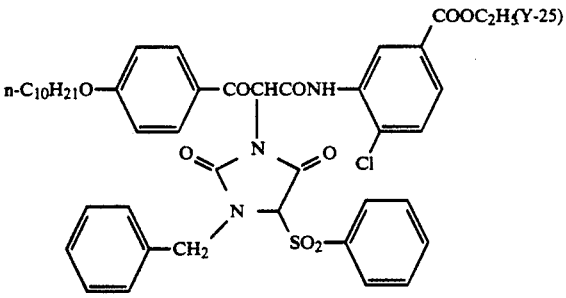
(Y-25)
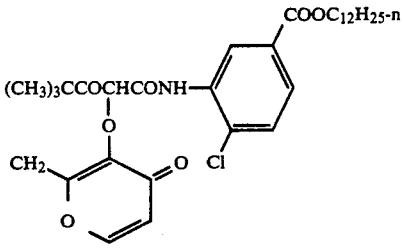
(Y-26)
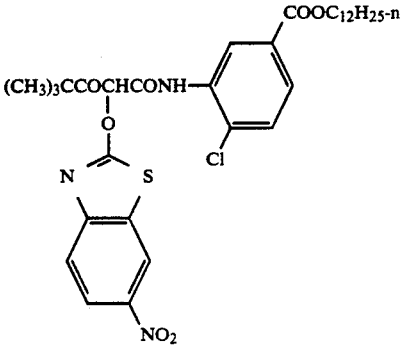
(Y-27)
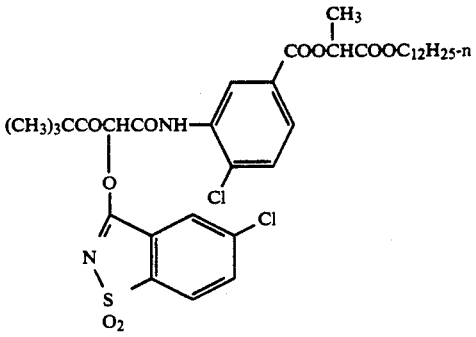
(Y-28)
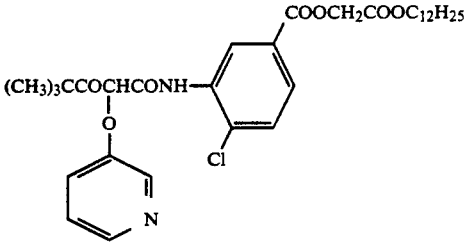
(Y-29)
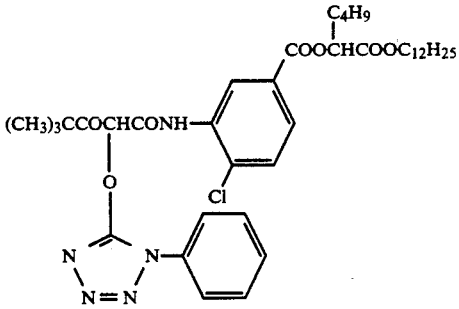
(Y-30)
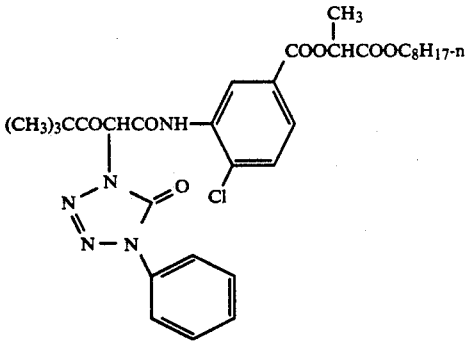
(Y-31)
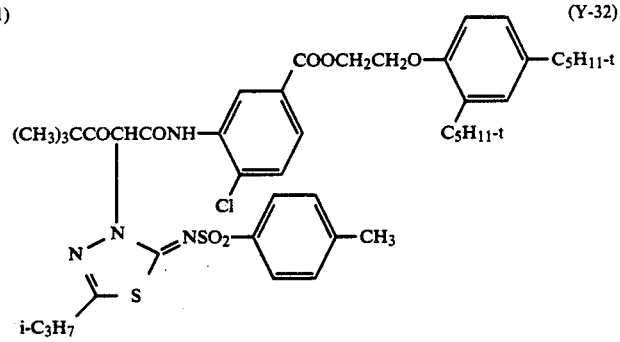
(Y-32)
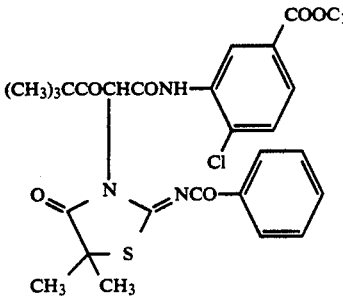
(Y-33)
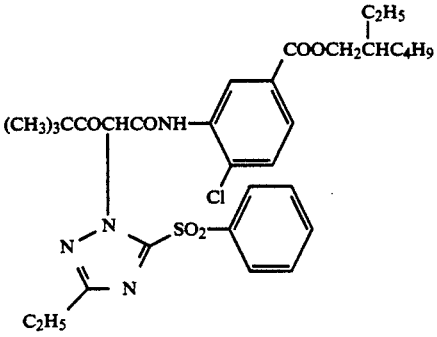
(Y-34)

-continued
(Y-35)
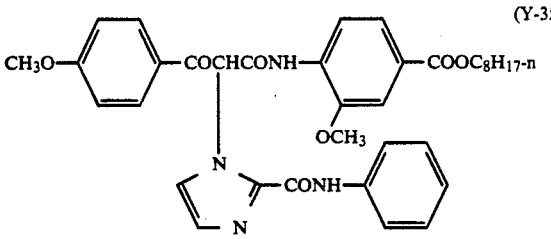
(Y-36)
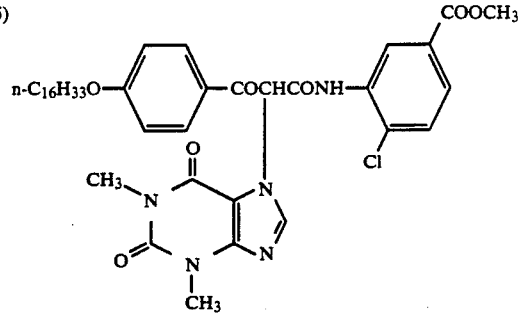
(Y-37)
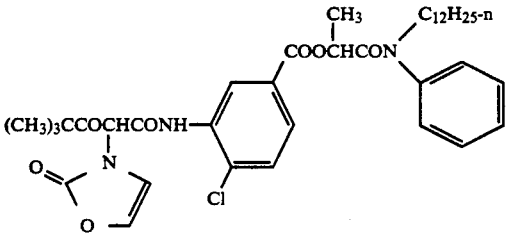
(Y-38)
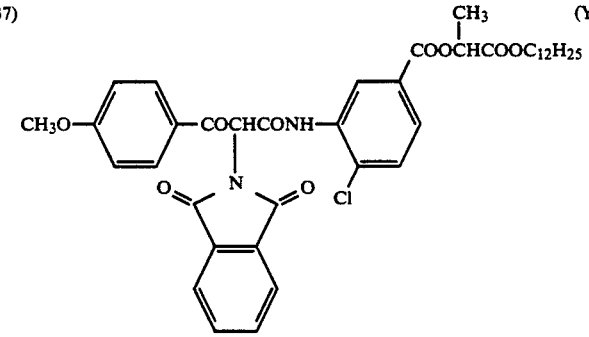
(Y-39)
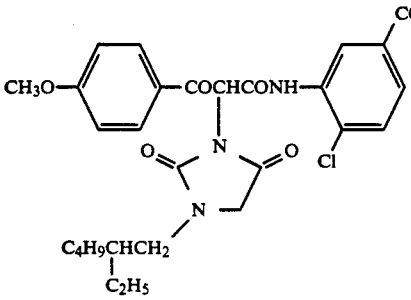
(Y-40)
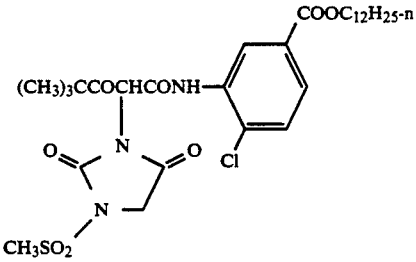
(Y-41)
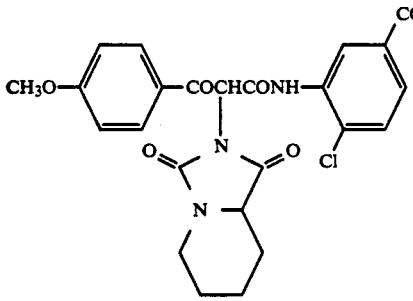
(Y-42)
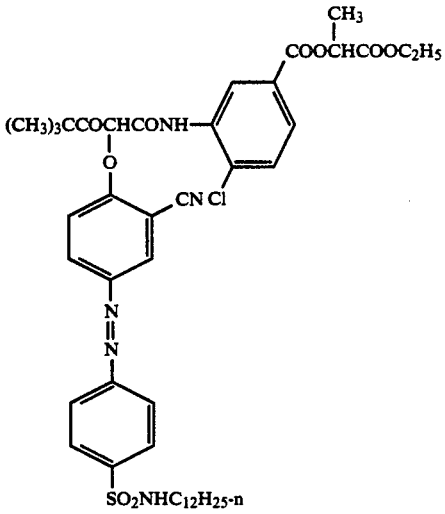

-continued (Y-43)

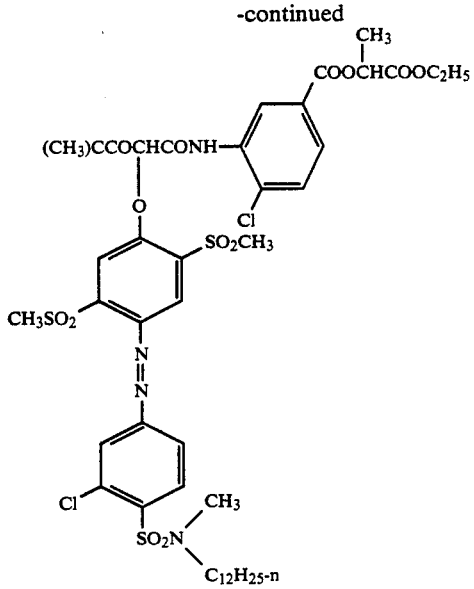

Other examples of the coupler represented by the general formula (I) and synthesis methods thereof are described, for example, in U.S. Pat. Nos. 3,408,194, 3,415,652, 3,447,928, 3,542,840, 3,644,498, 3,730,722, 3,973,968, 3,990,896, 4,008,086, 4,012,259, 4,022,620, 4,032,347, 4,046,575, 4,057,432, 4,115,121, 4,133,958, 4,206,278, 4,269,936, 4,304,845, 4,314,023, 4,326,024, 4,401,752, 4,404,274, and 4,511,649, JP-A-47-26133, JP-A-58-118644, JP-A-58-120251, JP-A-58-125039, JP-A-58-139138, JP-A-59-174839, JP-A-60-35730, JP-A-60-144740, JP-A-61-156047, JP-A-61-184541, and *Research Disclosure*, 18053 (1979).

Polymers which can be employed in the present invention are described in detail as follows.

The polymer employed in the present invention must be water-insoluble but organic solvent soluble ones. However, with respect to reduction in sweating, polymers having a —CO— linkage in their main chain or side chain are preferred, and those having a —CON-$R^IR^{II}$ group (wherein $R^I$ and $R^{II}$, which may be the same or different, each represent a hydrogen atom, a substituted or unsubstituted alkyl group or a substituted or unsubstituted aryl group) in their side chain are particularly preferred.

The term "water-insoluble" as used herein means that no more than 0.5 g of polymer is soluble in 100 ml of water at 40° C. The term "organic solvent soluble" as used herein means that at least 1.0 g of polymer is soluble in 100 ml of ethyl acetate at 40° C.

Suitable examples of groups having the —CO—linkage include an acyl group (for example, acetyl, benzoyl), an alkyl- or aryl-oxycarbonyl group (for example, methoxycarbonyl, ethoxycarbonyl, n-propoxycarbonyl, n-butoxycarbonyl, n-hexyloxycarbonyl, phenoxycarbonyl, p-tolyloxycarbonyl), a carbonamido group (for example, acetylamino, ethylcarbonylamino, n-butylcarbonylamino, tert-butylcarbonylamino), a carbamoyl group (for example, dimethylcarbamoyl, ethylcarbamoyl), a ureido group (for example, phenylureido, dimethylureido), and an acyloxy group (for example, acetyloxy, propionyloxy, benzoyloxy).

In the —CON$R^IR^{II}$ group, $R^I$ and $R^{II}$, which may be the same or different, each represents a hydrogen atom, a substituted or unsubstituted alkyl group, or a substituted or unsubstituted aryl group. Suitable examples of the alkyl group represented by $R^I$ or $R^{II}$ is an alkyl group having from 1 to 18 carbon atoms (for example, methyl, ethyl, n-propyl, isopropyl, n-butyl, tert-butyl, n-dodecyl) and preferably an alkyl group having from 1 to 6 carbon atoms. Suitable examples of the aryl group represented by $R^I$ or $R^{II}$ include a phenyl group and a naphthyl group. Suitable examples of substituents for the alkyl group or aryl group include a halogen atom (for example, fluorine, chlorine, bromine, iodine), a nitro group, a cyano group, a hydroxyl group, a carboxyl group, a sulfo group, a mercapto group, an alkoxy group (for example, methoxy, ethoxy), an aryloxy group (for example, phenoxy), an alkylthio group (for example, methylthio, ethylthio, dodecylthio), an arylthio group (for example, phenylthio, tolylthio), an alkylsulfonyl group (for example, methylsulfonyl, benzylsulfonyl), an arylsulfonyl group (for example, phehylsulfonyl, p-tolylsulfonyl), a carbonamido group (for example, acetamido, benzamido, N-phenylacetamido), a sulfonamido group (for example, methylsulfonamido, phenylsulfonamido, p-tolylsulfonamido), an amino group (for example, amino, dimethylamino, pyrrolidyl, piperidyl, anilino), a carbamoyl group (for example, carbamoyl, N,N-dimethylcarbamoyl, N-dodecylcarbamoyl), an alkoxycarbonyl group (for example, methoxycarbonyl, ethoxycarbonyl, benzyloxycarbonyl), an aryloxycarbonyl group (for example, phenoxycarbonyl, p-tert-butylphenoxycarbonyl), an acyloxy group (for example, acetoxy), a sulfamoyl group (for example, sulfamoyl, dimethylsulfamoyl, dihexylsulfamoyl), an acyl group (for example, acetyl, benzoyl), an imido group (for example, succinimido), a ureido group (for example, 3,3-dimethylureido), an alkoxycarbonylamino group (for example, ethoxycarbonylamino), an aryl group (for example, phenyl, p-tolyl, p-methoxyphenyl, α-naphthyl, β-naphthyl) and a heterocyclic group (for example, 1-imidazolyl, 1-pyrazolyl, 2-pyridyl, 4-pyridyl, 2-quinolyl, 2-furyl, 2-thienyl, 1-benzotriazolyl, phthalimido).

The polymer used in the present invention must not contain a group capable of effecting a coupling reaction and/or oxidation-reduction reaction with an oxidation product of an aromatic primary amine developing agent (for example, a coupler moiety, dihydroxyphenyl group).

The polymers which can be used in the present invention are explained in more detail with reference to specific examples thereof, but the present invention should not be construed as being limited to these polymers.

(A) Vinyl polymers

Monomers for forming a vinyl polymer for use in the present invention include an acrylic acid ester, a methacrylic acid ester, a vinyl ester, an acrylamide, a methacrylamide, an olefin, a styrene, a vinyl ether and other vinyl monomers.

Specific examples of acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition molar number n=9), 1-bromo-2-methoxyethyl acrylate, and 1,1-dichloro-2-ethoxyethyl acrylate.

Specific examples of methacrylic acid esters include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate, (addition molar number n=6), allyl methacrylate, and dimethylaminoethyl methacrylate methyl chloride salt.

Specific examples of vinyl esters include vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate.

Specific examples of acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, and diacetonacrylamide.

Specific examples of methacrylamide include methacrylamide, methylmethacrylamide, ethylmethacrylamide, propylmethacrylamide, butylmethacrylamide, tertbutylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, and N-(2-acetoacetoxyethyl)methacrylamide.

Specific examples of olefins include dicyclopentadiene, ethylene, propylene, 1-butene, 1-pentene, vinyl chloride, vinylidene chloride, isoprene, chloroprene, butadiene, and 2,3-dimethylbutadiene.

Specific examples of styrenes include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, and vinyl benzoic acid methyl ester.

Specific examples of vinyl ethers include methyl vinyl ether, butyl vinyl ether, hexyl vinyl ether, methoxyethyl vinyl ether, and dimethylaminoethyl vinyl ether.

Specific examples of other vinyl monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, methacrylonitrile, vinylidene chloride, methylene malononitrile, and vinylidene.

Two or more kinds of monomers as those described above can be employed together to prepare copolymers for use in the present invention which are tailored to specific requirements (for example, improvement in the solubility of coupler, etc.). Furthermore, in order to increase color forming ability and organic solvent solubility of the polymer, comonomers having an acid group as given below can be employed to the extent that the copolymer obtained is not water-soluble.

Specific examples of such monomers having an acid group include acrylic acid; methacrylic acid; itaconic acid; maleic acid, a monoalkyl itaconate (for example, monomethyl itaconate, monoethyl itaconate, monobutyl itaconate); a monoalkyl maleate (for example, monomethyl maleate, monoethyl maleate, monobutyl maleate); citraconic acid; styrene sulfonic acid; vinylbenzylsulfonic acid; vinylsulfonic acid; an acryloyloxyalkylsulfonic acid (for example, acryloyloxymethylsulfonic acid, acryloyloxyethylsulfonic acid, acryloyloxypropylsulfonic acid); a methacryloyloxyalkylsulfonic acid (for example, methacryloyloxymethylsulfonic acid, methacryloyloxyethylsulfonic acid, methacryloyloxypropylsulfonic acid); an acrylamidoalkylsulfonic acid (for example, 2-acrylamido-2-methylethanesulfonic acid, 2-acrylamido-2-methylpropanesulfonic acid, 2-acrylamido-2-methylbutanesulfonic acid); a methacrylamidoalkylsulfonic acid (for example, 2-methacrylamido-2-methylethanesulfonic acid, 2-methacrylamido-2-methylpropanesulfonic acid, and 2-methacrylamido-2-methylbutanesulfonic acid).

The acid may be in the form of the salt of an alkali metal (for example, sodium, potassium) or an ammonium ion.

Where a vinyl monomer described above and a hydrophilic vinyl monomer, which by itself will form a water-soluble homopolymer, are used in the present invention as comonomers, the ratio of the hydrophilic monomer contained in the copolymer is limited only to the extent that the resulting copolymer is not water-soluble. Usually, the amount of hydrophilic monomer in the copolymer is preferably not more than 40 mol %, more preferably not more than 20 mol %, and further more preferably not more than 10 mol %. Furthermore, when a hydrophilic monomer is combined with a monomer having an acid group in forming a copolymer of the present invention, the amount of the acid group monomer contained in the copolymer is usually not more than 20 mol %, and preferably not more than 10 mol % for the storability of images, as described above. Most preferably, the copolymer is not formed from an acid group monomer.

Preferred monomers used in preparation of the polymer according to the present invention are methacrylate type monomers, acrylamide type monomer and methacrylamide type monomers.

(B) Polyester resins obtained by condensation of polyvalent alcohols and polybasic acids Useful polyvalent alcohols include a glycol having a structure of $HO\text{-}R_1\text{-}OH$, wherein $R_1$ represents a hydrocarbon chain having from 2 to about 12 carbon atoms, particularly an aliphatic hydrocarbon chain, and a polyalkylene glycol. Useful polybasic acids include those represented by the formula $HOOC\text{-}R_2\text{-}COOH$, wherein $R_2$ represents a single bond or a hydrocarbon chain having from 1 to about 12 carbon atoms.

Specific examples of the polyvalent alcohols include ethylene glycol, diethylene glycol, triethylene glycol, 1,2-propylene glycol, 1,3-propylene glycol, trimethylol propane, 1,4-butanediol, isobutylenediol, 1,5-pentanediol, neopentyl glycol, 1,6-hexanediol, 1,7 -heptanediol, 1,8-octanediol, 1,9-nonanediol, 1,10-decanediol, 1,11-undecanediol, 1,12-dodecanediol, 1,13-tridecanediol, 1,14-tetradecanediol, glycerol, diglycerol, triglycerol, 1-methylglycerol, erythritol, mannitol, and sorbitol.

Specific examples of polybasic acids include oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanecarboxylic acid, fumaric acid, maleic acid, itaconic acid, citraconic acid, phthalic acid, isophthalic acid, terephthalic acid, tetrachlorophthalic acid, mesaconic acid, isopimelic acid, cyclopentadiene-maleic anhydride adduct, and rosin-maleic anhydride adduct.

(C) Other polymers

A polyester obtained by ring-opening condensation is exemplified as shown below.

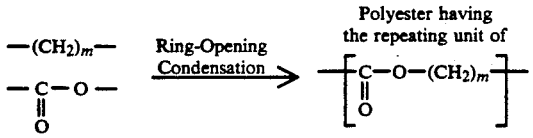

wherein m represents an integer from 4 to 7 and the $—CH_2—$ chain may be branched.

Suitable monomers for preparation of the polyester include β-propiolactone, ε-caprolactone, and dimethylpropiolactone.

The molecular weight and degree of polymerization of the polymer used in the present invention does not substantially influence the effect of the present invention as far as these values are large. However, as the molecular weight becomes higher, it takes longer to dissolve the polymer in an organic solvent or auxiliary solvent with a high boiling point. Emulsification or dispersion thereof also becomes difficult due to high solution viscosity and coarse grain formation, resulting in a decrease in the color forming property. Therefore, the molecular weight of the polymer which can be used in the present invention is preferably from 2,000 to 1,000,000, more preferably from 5,000 to 400,000, and further more preferably from 10,000 to 150,000.

The homopolymers and copolymers used in the present invention can be employed individually or in combinations of two or more. Furthermore, polymers other than those described in the present invention may be employed together with the polymers described in the present invention as far as the effect of the present invention can be achieved Moreover, different polymers may be employed in different layers of the photographic light-sensitive material.

Specific examples of the polymers which can be used in the present invention are set forth below, but the present invention should not be construed as being limited to these polymers.

P-1 Polyvinylacetate
P-2 Polyvinylpropionate
P-3 Polymethylmethacrylate
P-4 Polyethylmethacrylate
P-5 Polyethylacrylate
P-6 Copolymer of vinylacetate-vinylalcohol (95:5)
P-7 Poly(n-butylacrylate)
P-8 Poly(n-butylmethacrylate)
P-9 Poly(iso-butylmethacrylate)
P-10 Poly(iso-propylmethacrylate)
P-11 Poly(octylacrylate)
P-12 Copolymer of n-butylacrylate-acrylamide (95:5)
P-13 Copolymer of stearyl methacrylate-acrylic acid (90:10)
P-14 1,4-Butanediol-adipic acid polyester
P-15 Ethyleneglycol sebacic acid polyester
P-16 Polycaprolactone
P-17 Polypropiolactone
P-18 Polydimethylpropiolactone
P-19- Copolymer of n-butylmethacrylate-N-vinyl-2-pyrrolidone (90:10)
P-20 Copolymer of methylmethacrylate-vinyl chloride (70:30)
P-21 Copolymer of methylmethacrylate-styrene (90:10)
P-22 Copolymer of methylmethacrylateethylacrylate (50:50)
P-23 Copolymer of n-butylmethacrylate-methylmethacrylate-styrene (50:30:20)
P-24 Copolymer of vinylacetate-acrylamide (85:15)
P-25 Copolymer of vinyl chloride-vinylacetate (65:35)
P-26 Copolymer of methylmethacrylateacrylonitrile (65:35)
P-27 Copolymer of diacetonacrylamidemethylmethacrylate (50:50)
P-28 Copolymer of vinylmethylketone-isobutylmethacrylate (55:45)

P-29 Copolymer of ethylmethacrylate-nbutylacrylate (70:30)
P-30 Copolymer of diacetonacrylamide-nbutylacrylate (60:40)
P-31 Copolymer of methylmethacrylate-styrenemethylmethacrylate-diacetonacrylamide (40:40:20)
P-32 Copolymer of n-butylacrylate-styrenemethacrylate-diacetonacrylamide (70:20:10)
P-33 Copolymer of stearyl methacrylate-methylmethacrylate-acrylic acid (50:40:10)
P-34 Copolymer of methylmethacrylatestyrene-vinylsulfonamide (70:20:20)
P-35 Copolymer of methylmethacrylatephenylvinylketone (70:30)
P-36 Copolymer of n-butylacrylate-methylmethacrylate-n-butylmethacrylate (35:35:30)
P-37 Copolymer of n-butylmethacrylate.-pentylmethacrylate-N-vinyl-2-pyrrolrdone (38:38:24)
P-38 Copolymer of methylmethacrylate-n-butylmethacrylate-isobutylmethacrylate-acrylic acid (37:29:25:9)
P-39 Copolymer of n-butylmethacrylateacrylic acid (95:5)
P-40 Copolymer of methylmethacrylateacrylic acid (95:5)
P-41 Copolymer of benzylmethacrylateacrylic acid (90:10);
P-42 Copolymer of n-butylmethacrylatemethylmethacrylate-benzylmethacrylateacrylic acid (35:35:25:5)
P-43 Copolymer of n-butylmethacrylatemethylmethacrylate-benzylmethacrylate (35:35:30)
P-44 Polypentylacrylate
P-45 Copolymer of cyclohexylmethacrylatemethylmethacrylate-n-propylmethacrylate (37:29:34)
P-46 Polypentylmethacrylate
P-47 Copolymer of methylmethacrylate-nbutylmethacrylate (65:35)
P-48 Copolymer of vinylacetate-vinylpropionate (75:25)
P-49 Copolymer of n-butylmethacrylate-sodium-3-acryloxybutane-1-sulfonate (97:3)
P-50 Copolymer of n-butylmethacrylatemethylmethacrylate-acrylamide (35:35:30)
P-51 Copolymer of n-butylmethacrylate-methylmethacrylate-vinyl chloride (37:36:27)
P-52 Copolymer of n-butylmethacrylatestyrene (90:10)
P-53 Copolymer of methylmethacrylate-N-vinyl-2-pyrrolidone
P-54 Copolymer of n-butylmethacrylatevinyl chloride (90:10)
P-55 Copolymer of n-butylmethacrylate-styrene (70:30)
P-56 Poly(N-sec-butylacrylamide)
P-57 Poly(N-tert-butylacrylamide)
P-58 Copolymer of diacetonacrylamidemethylmethacrylate (62:38)
P-59 Polycyclohexylmethacrylate
P-60 Copolymer of N-tert-butylacrylamidemethylmethacrylate (40:60)
P-61 Poly(N,N-dimethylacrylamide)
P-62 Poly(tert-butylmethacrylate)
P-63 Copolymer of tert-butylmethacrylatemethylmethacrylate (70:30)
P-64 Poly(N-tert-butylmethacrylamide)
P-65 Copolymer of N-tert-butylacrylamidemethylphenylmethacrylate (60:40)
P-66 Copolymer of methylmethacrylateacrylonitrile (70:30)
P-67 Copolymer of methylmethacrylatevinylmethylketone (38:62)
P-68 Copolymer of methylmethacrylate-styrene (75:25)
P-69 Copolymer of methylmethacrylatehexylmethacrylate (70:30)

In accordance with the present invention, both the yellow coupler represented by the general formula (I) and the polymer of the present invention are incorporated into the photographic light-sensitive material. It is preferred that the polymer of the present invention is added to the same layer containing the yellow coupler represented by the general formula (I) and/or an adjacent layer thereto. More preferably, the polymer of the present invention is added to a light-sensitive layer adjacent to a light-sensitive silver halide emulsion layer containing the yellow coupler represented by the general formula (I). The polymer of the present invention could be added to a light-insensitive layer adjacent to a light-sensitive silver halide emulsion layer containing the yellow coupler represented by general formula (I).

The yellow coupler represented by the general formula (I) can be incorporated into a photographic light-sensitive material in the same manner as dispersing methods of couplers as described hereinafter.

The total amount of the yellow coupler represented by the general formula (I) to be added to the photographic light-sensitive material is usually from 0.005 g to 2.0 g, preferably from 0.05 g to 1.5 g and more preferably from 0.2 to 1.2 g per square meter of the photographic light-sensitive material.

The total amount of the polymer of the present invention to be added to the photographic light-sensitive material is usually from 0.003 g to 1.0 g, preferably from 0.01 g to 0.7 g and more preferably from 0.05 g to 0.5 g per m2 of the photographic light-sensitive material. Furthermore, the polymer according to the present invention is added at a weight ratio of polymer to gelatin contained in that layer, of usually from 0.001 to 0.5, preferably from 0.005 to 0.3 and more preferably from 0.02 to 0.2.

The polymer according to the present invention can be incorporated into a photographic light-sensitive material in various manner. More specifically, the polymer can be added by emulsifing and dispersing it in the same manner as methods used to disperse couplers as described hereinafter, or by dissolving the polymer in an organic solvent having a low boiling point such as an alcohol (for example, methanol, ethanol) or acetone. Alternatively, it may be added as a powder.

The polymer according to the present invention can be synthesized with reference to the methods described, for example, in *Fukajugo.Kaikanjugo* (Addition Polymerization.Ring-Opening-Polymerization), edited by Kobunshi-gakkai Kobunshijikkengakuhenshuiinkai (Kyoritsu Shuppan), *Jushukugo To Jufuka* (Polycondensation and Polyaddition), edited by Kobunshi-gakkai Kobunshijikkengakuhenshuiinkai (Kyoritsu Shuppan), and *Jugo To Kaijuqo* (Polymerization and Depolymerization), Kobunshi-gakkai Kobunshijikkengakukoza (Kyoritsu Shuppan).

For instance, P-1 can be synthesize.d according to the method as described in the above-mentioned *Fukajugo.-Kaikanjugo*, pages 30 to 34, P-21 can be synthesized according to the method described in ibid., page 95, Experimental Number 8, and P-3 can be synthesized according to the method described in ibid., pages 129 to 137.

A synthesis method of P-57 is specifically illustrated below but other polymers can be synthesized in a similar manner.

SYNTHESIS EXAMPLE OF P-57 t-Butylacrylamide was synthesized according to the method described in Herman Plant and John Ritter, *Journal of American Chemical Society*, Vol. 73, page 4076 (1951). A mixture of 50.0 g of t-butylacrylamide thus-prepared and 250 ml of toluene was heated at 80° C. with stirring under a nitrogen atmosphere in a 500 ml three-necked flask. 10 ml of a toluene solution containing 500 mg of azobisisobutyronitrile was added thereto to initiate polymerization. After polymerization for 3 hours, the polymerization solution was cooled and poured into 1 liter of hexane. The solid precipitates were collected by filtration, washed with hexane and dried while heating under reduced pressure to obtain 48.9 g of P-57.

In the photographic emulsion layers of the photographic light-sensitive material used in the present invention, the silver halide preferably employed is silver iodobromide, silver iodochloride or silver iodochlorobromide each containing about 30 mol % or less of silver iodide. Silver iodobromide containing from about 2 mol % to about 25 mol % of silver iodide is particularly preferred.

Silver halide grains in the silver halide emulsion may have a regular crystal structure, for example, a cubic, octahedral or tetradecahedral structure, etc., an irregular crystal structure, for example, a spherical or tabular structure, etc., a crystal defect, for example, a twin plane, etc., or a composite structure thereof.

The particle size of silver halide may vary and includes fine grains of about 0.2 micron or less to large size grains of about 10 microns of a diameter of projected area. Further, a polydispersed emulsion and a monodispersed emulsion may be used.

The silver halide photographic emulsion used in the present invention can be prepared using known methods, for example, those described in *Research Disclosure*, No. 17643 (December, 1978), pages 22 to 23, "I. Emulsion Preparation and Types" and ibid., No. 18716 (November, 1979), page 648, P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964), etc.

Monodispersed emulsions described in U.S. Pat. Nos. 3,574,628 and 3,655,394, and British Patent 1,413,748 are preferably used in the present invention.

Furthermore, tabular silver halide grains having an aspect ratio of about 5 or more can be employed in the present invention. The tabular grains may be easily prepared by the method described in Gutoff, *Photographic Science and Engineering*, Vol. 14, pages 248 to 257 (1970), U.S. Pat. Nos. 4,434,226, 4,414,310, 4,433,048 and 4,439,520, and British Patent 2,112,157.

Crystal structure of silver halide grains may be uniform, composed of different halide compositions between the inner portion and the outer portion, or may have a stratified structure.

Furthermore, silver halide emulsions in which silver halide grains having different composition are connected upon epitaxial junctions, may be employed. Silver halide emulsions in which silver halide grains are connected with compounds other than silver halide such as silver thiocyanate and lead oxide may also be employed.

Moreover, a mixture of grains having a different crystal structure may be used.

The silver halide emulsions used in the present invention are usually conducted with physical ripening, chemical ripening and spectral sensitization. Various kinds of additives which can be employed in these steps are described in *Research Disclosure*, No. 17643 (December, 1978) and ibid., No. 18716 (November, 1979) and concerned items thereof are summarized in the table shown below.

Furthermore, known photographic additives which can be used in the present invention are also described in the above mentioned literatures and are summarized in the table below.

| | Kind of Additives | RD 17643 | RD 18716 |
|---|---|---|---|
| 1. | Chemical Sensitizers | Page 23 | Page 648, right column |
| 2. | Sensitivity Increasing Agents | | Page 648, right column |
| 3. | Spectral Sensitizers and Supersensitizers | Pages 23 to 24 | Page 648, right column to page 649, right column |
| 4. | Whitening Agents | Page 24 | |
| 5. | Antifoggants and Stabilizers | Pages 24 to 25 | Page 649, right column |
| 6. | Light-Absobers, Filter Dyes and Ultraviolet Ray Absorbers | Pages 25 to 26 | Page 649, right column to page 650, left column |
| 7. | Antistaining Agents | Page 25, right column | Page 650, left column to right column |
| 8. | Dye Image Stabilizers | Page 25 | |
| 9. | Hardeners | Page 26 | Page 651, left column |
| 10. | Binders | Page 26 | Page 651, left column |
| 11. | Plasticizers and Lubricants | Page 27 | Page 650, right column |
| 12. | Coating Aids and Surfactants | Pages 26 to 27 | Page 650, right column |
| 13. | Antistatic Agents | Page 27 | Page 650, right column |

In the present invention, various color couplers can be employed and specific examples thereof are described in the patents cited in *Research Disclosure*, No. 17643, "VII-C" to "VII-G".

As yellow couplers used in the present invention, for example, those described in U.S. Pat. Nos. 3,933,501, 4,022,620, 4,326,024 and 4,401,752, JP-B-58-10739, British Patents 1,425,020 and 1,476,760, are preferred.

Magenta couplers used in the present invention are preferably of the 5-pyrazolone type and pyrazoloazole type compounds. Magenta couplers described in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June, 1984), JP-A-60-43659, U.S. Pat. Nos. 4,500,630 and 4,540,654 are particularly preferred.

Cyan couplers used in the present invention of the phenol type and naphthol type couplers are exemplified. Cyan couplers described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patent 121,365A, U.S. Pat. Nos. 3,446,622, 4,333,999, 4,451,559 and 4,427,767, and European Patent 161,626A are preferred.

Colored couplers for correcting undesirable absorptions of dyes formed as those described in *Research Disclosure*, No. 17643, "VII-G", U.S. Pat. No. 4,163,670, JP-B-57-39413, U.S. Pat. Nos. 4,004,929 and 4,138,258, and British Patent 1,146,368 are preferably employed.

Couplers capable of forming appropriately diffusible dyes as those described in U.S. Pat. No. 4,366,237, British Patent 2,125,570, European Patent 96,570, and West German Patent Application (OLS) No. 3,234,533 are preferably employed.

Typical examples of polymerized dye forming couplers are described in U.S. Pat. Nos. 3,451,820, 4,080,211 and 4,367,282, and Britlsh Patent 2,102,173.

Couplers capable of releasing a photographically useful residue during the course of coupling can be also employed preferably in the present invention. As DIR couplers capable of releasing a development inhibitor, those described in the patents cited in *Research Disclosure,* No. 17643, "VII-F" described above, JP-A-57-151944, JP-A-57-154234 and JP-A-60-184248, and U.S. Pat. No. 4,248,962. are preferred.

Couplers which release imagewise a nucleating agent or a development accelerator at the time of development as those described in British Patents 2,097,140 and 2,131,188, JP-A-59-157638 and JP-A-59-170840 are preferred.

Furthermore, competing couplers such as those described in U.S. Pat. No. 4,130,427, poly-equivalent couplers such as those described in U.S. Pat. Nos. 4,283,472, 4,338,393 and 4,310,618, DIR redox compound or DIR coupler releasing couplers or DIR coupler or DIR redox compound releasing redox compound such as those described in JP-A-60-185950 and JP-A-62-24252, couplers capable of releasing a dye which turns to a colored form after being released such as those described in European Patent 173,302A, bleach accelerator releasing couplers such as those described in *Research Disclosure,* No. 11449, ibid., 24241 and JP-A-61-201247, and ligand releasing couplers such as those described in U.S. Pat. No. 4,553,477 and the like may be employed in the photographic light-sensitive material of the present invention.

A color developing solution which can be used in the development processing of the color photographic light-sensitive material of the present invention is an alkaline aqueous solution containing preferably an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, hydrochloride, p-toluenesulfonate thereof, etc.

Two or more kinds of color developing agents may be employed in a combination thereof, depending on the purpose.

The color developing solution can ordinarily contain pH buffering agents, such as carbonates, borates or phosphates of alkali metals, etc.; and development inhibitors or antifaggants such as bromides, iodides, benzimidazoles, benzothiazoles, or mercapto compounds, etc. Furthermore, if necessary, the color developing solution may contain various preservatives such as hydroxylamine, diethylhydroxylamine, sulfites, hydrazines, phenylsemicarbazides, triethanolamine, catechol sulfonic acids, and triethylenediamine(1,4-diazabicyclo[2,2,2]octane); organic solvents such as ethylene glycol, and diethylene glycol; development accelerators such as benzyl alcohol, polyethylene glycol, quaternary ammonium salts, and amines.; dye forming couplers; competing couplers; fogging agents such as sodium borohydride; auxiliary developing agents such as 1-phenyl-3-pyrazolidone; viscosity imparting agents; and various chelating agents represented by aminopolycarboxylic acids, aminopolyphosphonic acids, alkylphosphonic acids, phosphonocarboxylic acids, etc. Representative examples of the chelating agents include ethylenediaminetetraacetic acid, nitrilotriacetic acid, diethylenetriaminepentaacetic acid, cyclohexanediaminetetraacetic acid, hydroxyethyl iminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(ohydroxyphenylacetic acid), and salts thereof.

In case of conducting reversal processing, color development is usually conducted after black-and-white development. In a black-and-white developing solution, known black-and-white developing agents, for example, dihydroxybenzenes such as hydroquinone, 3-pyrazolidones such as 1-phenyl-3-pyrazoldione, or aminophenols such as N-methyl-p-aminophenol may be employed individually or in a combination.

The pH of the color developing solution or the black-and-white developing solution is usually in a range from 9 to 12. Furthermore, an amount of replenishment for the developing solution varies depending on color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In the case of reducing the amount of replenishment, it is preferred to prevent evaporation and air oxidation of the processing solution by means of reducing the area of the processing tank which is contact with the air. Further, the amount of replenishment can be reduced by restraining accumulation of bromide ion in the developing solution.

Following color development, the photographic emulsion layers are usually subjected to a bleach processing. The bleach processing can be performed simultaneously with a fix processing (bleach-fix processing), or it can be performed independently of the fix processing. Furthermore, for purposes of rapid processing, bleach fixing may be conducted after bleach processing. Moreover, this process may be practiced using a continuous two tank bleach-fixing bath, such that fix processing is conducted before bleach-fix processing, or bleach processing is conducted after bleach-fix processing.

Examples of bleaching agents which can be employed in the bleach processing or bleach-fix processing include compounds of multivalent metals such as iron(III), cobalt(III), chromium(VI), and copper(II); peracids; quinones; and nitro compounds. Representative examples of the bleaching agents include ferricyanides; dichromates; organic complex salts of iron(III) or cobalt(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid), or complex salts of organic acids such as citric acid, tartaric acid, malic acid; persulfates; bromates; permanganates; nitrobenzenes; etc. Of these compounds, iron(III) complex salts of aminopolycarboxylic acids represented by iron(II ) complex salt of ethylenediaminetetraacetic acid and persulfates are preferred in view of rapid processing and environmental concerns. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in a range from 5.5 to 8. For the purpose of rapid processing, it is possible to process at pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfido group described, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July 1978); thiazolidine derivatives described, for example, in JP-A-50-140129; thiourea derivatives described, for example, in JP-B-45-8506, JP-A-52-20832, JP-A-53-32735 and U.S. Pat. No. 3,706,561; iodides as described, for example, in West German Patent 1,127,715 and JP-A-58-16235; polyoxyethylene compounds described, for example, in West German Patents 966,410 and 2,748,430; polyamine compounds described, for example, in JP-B-45-8836; compounds described, for example, in JP-A-49-42434, JP-A-49-59644, JP-A-53-94927, JP-A-54-35727, JP-A-55-26506 and JP-A-58-163940; and bromide ions. Of these compounds, the compounds having a mercapto group or a disulfido group are preferred in view of their large bleach accelerating effects. Particularly, the compounds described in U.S. Pat. No. 3,893,858, West German Patent 1,290,812 and JP-A-53-95630 are preferred. Furthermore, the compounds described in U.S. Pat. No. 4,552,834 are also preferred. These bleach accelerating agents may be incorporated into the color photographic light-sensitive material. These bleach accelerating agents are particularly effective when color photographic light-sensitive materials for photographing are subjected to bleach-fix processing.

Fixing agents which can be employed in the fixing solution or bleach-fixing solution include thiosulfates, thiocyanates, thioether compounds, thioureas, a large amount of iodide, etc. Of these compounds, thiosulfates are generally employed. Particularly, ammonium thiosulfate is most widely employed. Sulfites, bisulfites or carbonylbisulfite adducts are preferably used as preservatives in the bleach-fixing solution.

After desilvering, the silver halide color photographic material used in the present invention is generally subjected to a water washing step and/or a stabilizing step.

The amount of water required for the water washing step depends on the characteristics of photographic light-sensitive materials (due to elements used therein, for example, couplers), the uses thereof, the temperature of washing water, the number of water washing tanks (number of stage), the replenishment system employed (countercurrent or orderly current), or other various conditions. A relationship between the number of water washing tanks and the amount of water in a multi-stage countercurrent system can be determined based on the method described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, increased staying time of water in a tank results in propagation of bacteria and in adhesion of floatage on the photographic materials. In processing the silver halide color photographic material of the present invention, a method for reducing amounts of calcium ion and magnesium ion described in JP-A-62-288838 can be effectively employed in order to solve such problems. Furthermore, sterilizers, for example, isothiazol.one compounds described in JP-A-57-8542, thiabendazoles, chlorine type sterilizers such as sodium chloroisocyanurate, benzotriazoles, and sterilizers described in Hiroshi Horiguchi, *Bokin-Bobai No Kaqaku, Biseibutsu No Mekkin-, Sakkin-, Bobai-Gijutsu,* edited by Eiseigijutsu Kai, and *Bokin-Bobaizai Jiten,* edited by Nippon Bokin-Bobai Gakkai can be employed.

A pH of the washing water used in the processing of the photographic light-sensitive materials of the present invention is usually from 4 to 9, and preferably from 5 to 8. The temperature of the washing water and the time for a water washing step varies depending on characteristics or uses of the photographic light-sensitive materials, etc. However, a temperature range of from 15° C. to 45° C. and a washing period from 20 sec. to 10 min. is usually selected and preferably a range of from 25° C. to 40° C. and a period from 30 sec. to 5 min.

The photographic light-sensitive material of the present invention can also be directly processed with a stabilizing solution in place of the above-described water washing step. In such a stabilizing process, various known methods described, for example, in JP-A-57-8543, JP-A-58-14834 and JP-A-60-220345 can be employed.

Furthermore, it is possible to conduct the stabilizing process subsequent to the above-described water washing process. One example thereof is a stabilizing bath containing formalin and a surface active agent, which is employed as a final bath in the processing of color photographic light-sensitive materials for photographing. Various chelating agents and antimolds may also be added to the stabilizing bath.

Overflow solutions resulting from replenishmen for the above-described washing water and/or stabilizing solution may be reused in other steps such as the desilvering step.

In order to simplify and accelerate processing, a color developing agent may be incorporated into the silver halide color photographic material of the present invention. The color developing agent is preferably incorporated as various precursors of color developing agents. Examples of developing agent precursors include indoaniline type compounds described in U.S. Pat. Nos. 3,342,597, Schiff's base type compounds described in U.S. Pat. No. 3,342,599 and *Research Disclosure,* No. 14850 and ibid., No. 15159, aldol compounds described in *Research Disclosure,* No. 13924, metal salt complexes described in U.S. Pat. No. 3,719,492, and urethane type compounds described in JP-A-53-135628.

Furthermore, the silver halide color photographic material of the present invention may contain, if desired, various 1-phenyl-3-pyrazolidones for accelerating color development. Typical examples of such compounds include those described in JP-A-56-64339, JP-A-57-144547, and JP-A-58-115438.

In the present invention, a temperature range from 10° C. to 50° C. is suitable for various kinds of processing solutions. Although the typical temperature range is from 33° C. to 38° C., it is possible to employ a higher temperature in order to accelerate the processing whereby the processing time is shortened, or a lower temperature in order to achieve improvement in image quality and to maintain stability of the processing solutions.

Furthermore, for the purpose of saving an amount of silver employed in the color photographic light-sensitive material, the photographic processing may be conducted utilizing color intensification using cobalt or hydrogen peroxide as described in West German Patent Application (OLS) No. 2,226,770 or U.S. Pat. No. 3,674,499.

Moreover, the silver halide color photographic material of the present invention can be applied to heat-developable light-sensitive materials as described, for example, in U.S. Pat. No. 4,500,626, JP-A-60-133449, JP-A-59-218443, JP-A-61-238056 and European Patent 210,660A2.

The present invention is explained in greater detail with reference to the following examples, but the present invention should not be construed as being limited thereto.

EXAMPLE 1

Sample 101

To prepare Sample 101 a cellulose triacetate film support provided with a subbing layer was coated in layers having the compositions as set forth below:

| | |
|---|---|
| First Layer: Gelatin Subbing Layer | |
| HBS-1 | 0.15 g/m$^2$ |
| Gelatin | 1.2 g/m$^2$ |
| Second Layer: Emulsion Layer | |
| Monodispersed silver iodobromide emulsion (silver iodide: 8 mol %, average particle size: 0.55 μm, coefficient of variation concerning particle size: 0.17) | 0.40 g/m$^2$ (as silver) |
| R-1 | 0.90 g/m$^2$ |
| HBS-1 | 0.18 g/m$^2$ |
| Gelatin | 1.6 g/m$^2$ |
| Third Layer: Protective Layer | |
| Gelatin | 1.5 g/m$^2$ |
| 6-Hydroxy-2,4-dichloro-s-triazine sodium salt | 0.15 g/m$^2$ |

Samples 102 to 107

Samples 102 to 107 were prepared in the same manner as described for Sample 101, substituting the couplers given in Table 1 below in place of coupler R-1 as used in Sample 101. The same quantity of coupler used in Sample 101 was also used in Samples 102 to 107.

Samples 108 to 114

Samples 108 to 114 were prepared in the same manner as Samples 101 to 107, except that Polymer P-57, according to the present invention, was added in a coating amount of 0.25 g/m$^2$ to the first layer of Samples 101 to 107.

In the preparation of Samples 108 to 114, 50 g of P-57 and 30 g of HBS-1 were dissolved by heating in 200 ml of ethyl acetate. The solution was then emulsified and dispersed in 800 g of a 10% aqueous solution of bone gelatin containing 0.5 g of sodium dodecylsulfate using a home mixer. The emulsified dispersion was added to the coating solution.

These samples were exposed imagewise and subjected to color development processing as described below. The relative sensitivity and gamma of each sample thus-processed was measured.

Furthermore, sample strips after processing were stored at 80° C. and 70% relative humidity for 7 days. The presence of sweating on each sample was thus observed.

The results thus obtained are shown in Table 1 below.

Color development processing was carried out according to the processing steps set forth below at a processing temperature of 38° C.

| Processing Step | Time |
|---|---|
| Color Development | 3 min. 15 sec. |
| Bleaching | 3 min. 15 sec. |
| Washing with Water | 6 min. 30 sec. |
| Fixing | 2 min. 10 sec. |
| Washing with Water | 4 min. 20 sec. |
| Stabilizing | 3 min. 15 sec. |

The composition of the processing solution used in each step is illustrated below.

| | |
|---|---|
| Color Developing Solution: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 l |
| pH | 10.0 |
| Bleaching Solution: | |
| Iron (III) ammonium ethylenediaminetetraacetate | 100.0 g |
| Disodium ethylenediaminetetraacetate | 10.0 g |
| Ammonium bromide | 150.0 g |
| Ammonium nitrate | 10.0 g |
| Water to make | 1.0 l |
| pH | 6.0 |
| Fixing Solution: | |
| Disodium ethylenediaminetetraacetate | 1.0 g |
| Sodium sulfite | 4.0 g |
| Ammonium thiosulfate (70% aq. soln.) | 175.0 ml |
| Sodium bisulfite | 4.6 g |
| Water to make | 1.0 l |
| pH | 6.6 |
| Stabilizing Solution: | |
| Formalin (40%) | 2.0 ml |
| Polyoxyethylene-p-monononylphenylether (average degree of polymerization: 10) | 0.3 g |
| Water to make | 1.0 l |

TABLE 1

| Sample | Coupler | Compound added to Subbing Layer | Relative* Sensitivity | Gamma | Presence of Sweating |
|---|---|---|---|---|---|
| 101 (Comparison) | R-1 | none | 0 | 1.23 | no |
| 102 (Comparison) | R-2 | none | 0.03 | 1.33 | no |
| 103 (Comparison) | R-3 | none | 0.02 | 1.29 | no |
| 104 (Comparison) | R-4 | none | 0.02 | 1.30 | no |
| 105 (Comparison) | Y-1 | none | 0.07 | 1.45 | yes |
| 106 (Comparison) | Y-2 | none | 0.06 | 1.42 | yes |
| 107 (Comparison) | Y-8 | none | 0.08 | 1.40 | yes |
| 108 (Comparison) | R-1 | P-57 | 0.01 | 1.24 | no |
| 109 (Comparison) | R-2 | P-57 | 0.04 | 1.34 | no |
| 110 (Comparison) | R-3 | P-57 | 0.03 | 1.29 | no |
| 111 (Comparison) | R-4 | P-57 | 0.03 | 1.32 | no |
| 112 (Invention) | Y-1 | P-57 | 0.08 | 1.43 | no |
| 113 (Invention) | Y-2 | P-57 | 0.07 | 1.42 | no |
| 114 (Invention) | Y-8 | P-57 | 0.10 | 1.41 | no |

*The sensitivity is shown as a logarithm of a reciprocal of the exposure amount required to obtain a density of fog + 0.2. The sensitivity of Sample 101 is taken as 0 and the other sensitivities are shown relatively to Sample 101.

It is apparent from the results shown in Table 1 above that Samples 105, 106 and 107 using only the yellow coupler of the present invention but without the polymer have a sweating problem, although they do have high sensitivity and high gamma. Samples 108, 109, 110 and 111 each using only the polymer according to the present invention exhibit poor color forming properties, but are free from sweating. On the contrary, the samples according to the present invention are free from sweating as well as of high sensitivity and high gamma.

EXAMPLE 2

Sample 201

A cellulose triacetate film support provided with a subbing layer was coated in layers having the compositions set forth below to prepare a multilayer color photographic light-sensitive material designated as Sample 201.

With respect to the layer compositions, coated amounts of silver halide and colloidal silver are shown by a silver coated amount in units of g/m$^2$, those of couplers, additives and gelatin are shown in units of g/m$^2$, those of sensitizing dyes are shown as a molar amount per mol of silver halide present in the same layer.

| | |
|---|---|
| First Layer: Antihalation Layer | |
| Black colloidal silver | 0.18 g/m$^2$ (as silver) |
| Gelatin | 0.40 g/m$^2$ |
| Second Layer: Intermediate Layer | |
| 2,5-Di-tert-pentadecylhydroquinone | 0.18 g/m$^2$ |
| EX-1 | 0.07 g/m$^2$ |
| EX-3 | 0.02 g/m$^2$ |
| EX-12 | 0.002 g/m$^2$ |
| U-1 | 0.06 g/m$^2$ |
| U-2 | 0.08 g/m$^2$ |
| U-3 | 0.10 g/m$^2$ |
| HBS-1 | 0.10 g/m$^2$ |
| HBS-2 | 0.02 g/m$^2$ |
| Gelatin | 1.04 g/m$^2$ |
| Third Layer: First Red-Sensitive Emulsion Layer | |
| Monodispersed silver iodobromide emulsion (silver iodide: 6 mol %, average particle size: 0.6 μm coefficient of variation concerning particle size: 0.19) | 0.55 g/m$^2$ (as silver) |
| Sensitizing dye I | $6.9 \times 10^{-5}$ mol/Agmol |
| Sensitizing dye II | $1.8 \times 10^{-5}$ mol/Agmol |
| Sensitizing dye III | $3.1 \times 10^{-4}$ mol/Agmol |
| Sensitizing dye IV | $4.0 \times 10^{-5}$ mol/Agmol |

-continued

| | |
|---|---|
| EX-2 | 0.350 g/m$^2$ |
| HBS-1 | 0.005 g/m$^2$ |
| EX-10 | 0.020 g/m$^2$ |
| Gelatin | 1.20 g/m$^2$ |
| Fourth Layer: Second Red-Sensitive Emulsion Layer | |
| Tabular silver iodobromide emulsion (silver iodide: 8 mol %, average particle size: 0.7 μm, average aspect ratio: 5.5, average thickness: 0.2 μm) | 1.0 g/m$^2$ (as silver) |
| Sensitizing dye I | $5.1 \times 10^{-5}$ mol/Agmol |
| Sensitizing dye II | $1.4 \times 10^{-4}$ mol/Agmol |
| Sensitizing dye III | $2.3 \times 10^{-4}$ mol/Agmol |
| Sensitizing dye IV | $3.0 \times 10^{-5}$ mol/Agmol |
| EX-2 | 0.400 g/m$^2$ |
| EX-3 | 0.050 g/m$^2$ |
| EX-10 | 0.015 g/m$^2$ |
| Gelatin | 1.30 g/m$^2$ |
| Fifth Layer: Third Red-Sensitive Emulsion Layer | |
| Silver iodobromide emulsion (silver iodide: 16 mol %, average particle size: 1.1 μm) | 1.60 g/m$^2$ (as silver) |
| Sensitizing dye IX | $5.4 \times 10^{-6}$ mol/Agmol |
| Sensitizing dye II | $1.4 \times 10^{-5}$ mol/Agmol |
| Sensitizing dye III | $2.4 \times 10^{-4}$ mol/Agmol |
| Sensitizing dye IV | $3.1 \times 10^{-5}$ mol/Agmol |
| EX-9 | 0.005 g/m$^2$ |
| EX-3 | 0.240 g/m$^2$ |
| EX-4 | 0.120 g/m$^2$ |
| HBS-1 | 0.22 g/m$^2$ |
| HBS-2 | 0.10 g/m$^2$ |
| Gelatin | 1.63 g/m$^2$ |
| Sixth Layer: Intermediate Layer | |
| EX-5 | 0.040 g/m$^2$ |
| HBS-1 | 0.020 g/m$^2$ |
| Gelatin | 0.80 g/m$^2$ |
| Seventh Layer: First Green-Sensitive Emulsion Layer | |
| Tabular silver iodobromide emulsion (silver iodide: 6 mol % average particle size: 0.6 μm, average aspect ratio 6.0, average thickness: 0.15 μm) | 0.40 g/m$^2$ (as silver) |
| Sensitizing dye V | $3.0 \times 10^{-5}$ mol/Agmol |
| Sensitizing dye VI | $1.0 \times 10^{-4}$ mol/Agmol |
| Sensitizing dye VII | $3.8 \times 10^{-4}$ mol/Agmol |
| EX-6 | 0.260 g/m$^2$ |
| EX-1 | 0.021 g/m$^2$ |
| EX-7 | 0.030 g/m$^2$ |
| EX-8 | 0.025 g/m$^2$ |
| HBS-1 | 0.100 g/m$^2$ |
| HBS-4 | 0.010 g/m$^2$ |
| Gelatin | 0.75 g/m$^2$ |
| Eighth Layer: Second Green-Sensitive Emulsion Layer | |
| Monodispersed silver iodobromide emulsion (silver iodide: 10 mol %, average particle size: 0.7 μm, coefficient of variation concerning particle size: 0.19) | 0.80 g/m$^2$ (as silver) |
| Sensitizing dye V | $2.1 \times 10^{-5}$ mol/Agmol |
| Sensitizing dye VI | $7.0 \times 10^{-5}$ mol/Agmol |
| Sensitizing dye VII | $2.6 \times 10^{-4}$ mol/Agmol |
| EX-6 | 0.180 g/m$^2$ |
| EX-8 | 0.010 g/m$^2$ |
| EX-1 | 0.008 g/m$^2$ |
| EX-7 | 0.012 g/m$^2$ |
| HBS-1 | 0.160 g/m$^2$ |
| HBS-4 | 0.008 g/m$^2$ |
| Gelatin | 1.10 g/m$^2$ |
| Ninth Layer: Third Green-Sensitive Emulsion Layer | |
| Silver iodobromide emulsion (silver iodide: 12 mol % average particle size: 1.0 μm) | 1.2 g/m$^2$ (as silver) |
| Sensitizing dye V | $3.5 \times 10^{-5}$ mol/Agmol |
| Sensitizing dye VI | $8.0 \times 10^{-5}$ mol/Agmol |
| Sensitizing dye VII | $3.0 \times 10^{-4}$ mol/Agmol |
| EX-6 | 0.065 g/m$^2$ |
| EX-11 | 0.030 g/m$^2$ |
| EX-1 | 0.025 g/m$^2$ |
| HBS-1 | 0.25 g/m$^2$ |
| HBS-2 | 0.10 g/m$^2$ |
| Gelatin | 1.74 g/m$^2$ |
| Tenth Layer: Yellow Filter Layer | |
| Yellow colloidal silver | 0.05 g/m$^2$ |

-continued

| | |
|---|---|
| | (as silver) |
| EX-13 | 0.15 g/m$^2$ |
| HBS-3 | 0.10 g/m$^2$ |
| Gelatin | 0.95 g/m$^2$ |
| Eleventh Layer: First Blue-Sensitive Emulsion Layer | |
| Tabular silver iodobromide emulsion (silver iodide: 6 mol %, average particle size: 0.6 μm, average aspect ratio: 5.7, average thickness: 0.15 μm) | 0.24 g/m$^2$ (as silver) |
| Sensitizing dye VIII | $3.5 \times 10^{-4}$ mol/Agmol |
| R-2 | 0.97 g/m$^2$ |
| EX-8 | 0.12 g/m$^2$ |
| HBS-1 | 0.28 g/m$^2$ |
| Gelatin | 1.0 g/m$^2$ |
| Twelfth Layer: Second Blue-Sensitive Emulsion Layer | |
| Monodispersed silver iodobromide emulsion (silver iodide: 10 mol %, average particle size: 0.8 μm, coefficient of variation concerning particle size: 0.16) | 0.30 g/m$^2$ (as silver) |
| Sensitizing dye VIII | $2.1 \times 10^{-4}$ mol/Agmol |
| R-2 | 0.23 g/m$^2$ |
| EX-10 | 0.015 g/m$^2$ |
| HBS-1 | 0.03 g/m$^2$ |
| Gelatin | 0.46 g/m$^2$ |
| Thirteenth Layer: Third Blue-Sensitive Emulsion Layer | |
| Silver iodobromide emulsion (silver iodide: 14 mol %, average particle size: 1.3 μm) | 0.70 g/m$^2$ (as silver) |
| Sensitizing dye VIII | $2.2 \times 10^{-4}$ mol/Agmol |
| R-2 | 0.22 g/m$^2$ |
| HBS-1 | 0.07 g/m$^2$ |
| Gelatin | 0.69 g/m$^2$ |
| Fourteenth Layer: First Protective Layer | |
| Silver iodobromide emulsion (silver iodide: 1 mol %, average particle size: 0.07 μm) | 0.5 g/m$^2$ (as silver) |
| U-4 | 0.11 g/m$^2$ |
| U-3 | 0.05 g/m$^2$ |
| U-5 | 0.17 g/m$^2$ |
| HBS-1 | 0.90 g/m$^2$ |
| Gelatin | 1.00 g/m$^2$ |
| Fifteenth Layer: Second Protective Layer | |
| Polymethyl acrylate particle (diameter: about 1.5 μm) | 0.54 g/m$^2$ |
| S-1 | 0.05 g/m$^2$ |
| S-2 | 0.15 g/m$^2$ |
| Gelatin | 1.50 g/m$^2$ |

Gelatin Hardener H-1 and a surface active agent were added to each of the layers in addition to the above described components.

Samples 202 to 205

Samples 202 to 205 were prepared in the same manner as described for Sample 201, except that Polymers P-7, P-60, P-62 and P-57 according to the present invention were added in a coating amount of 0.15 g/m$^2$ to the tenth layer.

Samples 206 to 215

Samples 206 to 215 were prepared in the same manner as described for Samples 201 to 205, except that an equimolar amount of coupler, as shown in Table 2 below, was used in place of Coupler R-2 in the eleventh layer, the twelfth layer and the thirteenth layer of Samples 201 to 205, respectively.

These samples were exposed imagewise to white light and subjected to the color development processing described below. The yellow density of each sample thus-processed was measured and the relative sensitivity was determined.

Furthermore, sample strips following processing were stored at 80° C. and 70% relative humidity for 7 days. The presence of sweating on each sample was observed.

Moreover, each sample was exposed to white light through a pattern in order to measure the MTF value, color development processed according to the processing steps described below and then stored at 80° C. and 70% relative humidity for 24 hours. Thereafter, the MTF value of yellow image at 40 cycles/nm thereof was measured. The measurement of MTF value was conducted according to the method as described in Mees, *The Theory of the Photographic Process*, Third Edition (The Macmillan Company).

Color development processing was carried out according to the processing steps set forth below at a processing temperature of 38° C. using an automatic developing machine.

| Processing Step | Time |
|---|---|
| Color Development | 3 min. 15 sec. |
| Bleaching | 1 min. |
| Bleach-Fixing | 3 min. 15 sec. |
| Washing with Water (1) | 40 sec. |
| Washing with Water (2) | 1 min. |
| Stabilizing | 40 sec. |

-continued

| Processing Step | Time |
|---|---|
| Drying (at 50° C.) | 1 min. 15 sec. |

In the above described processing steps, the water washing steps were carried out using a countercurrent washing process.

The composition of each processing solution is illustrated below.

The processing solution replenishement amounts solutions were 1,200 ml/m$^2$ of the color photographic light-sensitive material with respect to the color development step and 800 ml/m$^2$ of the color photographic light-sensitive material with respect to other processing steps including the water washing step. Furthermore, the amount of processing solution carried over from the preceding bath to the water washing step was 50 ml/m$^2$ of the color photographic light-sensitive material.

| | Tank Solution | Replenisher |
|---|---|---|
| Color Developing Solution: | | |
| Diethylenetriaminepenta-acetic acid | 1.0 g | 1.1 g |
| 1-Hydroxyethylidene-1,1-diphosphonic acid | 2.0 g | 2.2 g |
| Sodium sulfite | 4.0 g | 4.4 g |
| Potassium carbonate | 30.0 g | 32.0 g |
| Potassium bromide | 1.4 g | 0.7 g |
| Potassium iodide | 1.3 mg | — |
| Hydroxylamine sulfate | 2.4 g | 2.6 g |
| 4-(N-Ethyl-N-β-hydroxyethyl amino)-2-methylaniline sulfate | 4.5 g | 5.0 g |
| Water to make | 1.0 l | 1.0 l |
| pH | 10.0 | 10.05 |
| Bleaching Solution: (both Tank Solution and Replenisher) | | |
| Ammonium iron (III) ethylenediamine-tetraacetate | | 120.0 g |
| Disodium ethylenediaminetetraacetate | | 10.0 g |
| Ammonium nitrate | | 10.0 g |
| Ammonium bromide | | 100.0 g |
| Bleach accelerating agent: | | $5 \times 10^{-3}$ mol |

-continued

| | Tank Solution | Replenisher |
|---|---|---|
| 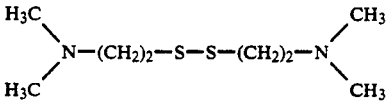 | | |
| pH adjusted with aqueous ammonia | | 6.3 |
| Water to make | | 1.0 l |
| Bleach-Fixing Solution: (both Tank Solution and Replenisher) | | |
| Ammonium iron (III) ethylenediaminetetra-acetate | | 50.0 g |
| Disodium ethylenediaminetetraacetate | | 5.0 g |
| Sodium sulfite | | 12.0 g |
| Aqueous solution of ammonium thiosulfate (70%) | | 240.0 ml |
| pH adjusted with aqueous ammonia | | 7.3 |
| Water to make | | 1.0 l |

Washing Water

City water containing 32 mg/l of calcium ion and 7.3 mg/l of magnesium ion was passed through a column filled with an H type strong acidic cation exchange resin and an OH type strong basic anion exchange resin to prepare water containing 1.2 mg/l of calcium ion and 0.4 mg/l of magnesium ion. Sodium dichloroisocyanulate in an amount of 20 mg/l was added to the treated water.

| | |
|---|---|
| Stabilizing Solution: (both Tank Solution and Replenisher) | |
| Formalin (37% w/v) | 2.0 ml |
| Polyoxyethylene-p-monononylphenylether (average degree of polymerization = 10) | 0.3 g |
| Disodium ethylenediaminetetraacetate | 0.05 g |
| Water to make | 1.0 l |
| pH | 5.8 |
| Drying: | |
| The temperature of drying was 50° C. | |

TABLE 2

| Sample | Coupler in 11th, 12th and 13th Layers | Compound in 10th Layer | Relative* Sensitivity | MTF Value (at 40 cycles/mm) | Presence of Sweating |
|---|---|---|---|---|---|
| 201 (Comparison) | R-2 | — | 0 | 0.60 | no |
| 202 (Comparison) | R-2 | P-7 | 0 | 0.60 | no |
| 203 (Comparison) | R-2 | P-60 | 0 | 0.61 | no |
| 204 (Comparison) | R-2 | P-62 | 0 | 0.60 | no |
| 205 (Comparison) | R-2 | P-57 | 0.01 | 0.60 | no |
| 206 (Comparison) | Y-2 | — | 0.06 | 0.58 | yes |
| 207 (Invention) | Y-2 | P-7 | 0.06 | 0.62 | slight |
| 208 (Invention) | Y-2 | P-60 | 0.06 | 0.63 | no |
| 209 (Invention) | Y-2 | P-62 | 0.07 | 0.63 | no |
| 210 (Invention) | Y-2 | P-57 | 0.07 | 0.63 | no |
| 211 (Comparison) | Y-9 | — | 0.04 | 0.57 | yes |
| 212 (Invention) | Y-9 | P-7 | 0.04 | 0.61 | slight |
| 213 (Invention) | Y-9 | P-60 | 0.05 | 0.62 | no |
| 214 | Y-9 | P-62 | 0.04 | 0.63 | no |

TABLE 2-continued

| Sample | Coupler in 11th, 12th and 13th Layers | Compound in 10th Layer | Relative* Sensitivity | MTF Value (at 40 cycles/mm) | Presence of Sweating |
|---|---|---|---|---|---|
| (Invention) 215 (Invention) | Y-9 | P-57 | 0.05 | 0.63 | no |

*The sensitivity is shown as a logarithm of a reciprocal of the exposure amount required to obtain a density of fog + 0.5. The sensitivity of Sample 201 is taken as 0 and the other sensitivities are shown relative to Sample 201.

From the results shown in Table 2 above, it is apparent that the samples according to the present invention have high sensitivity, are free from sweating, and excellent in sharpness even when they are undergone the high temperature and high humidity condition after processing.

The compounds employed in the photographic light-sensitive materials used in Examples 1 and 2 are set forth below.

(coupler used in JP-A-53-32034) R-1

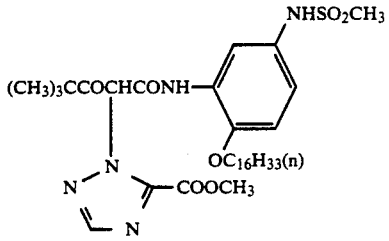

(coupler used in JP-A-59-202465) R-2

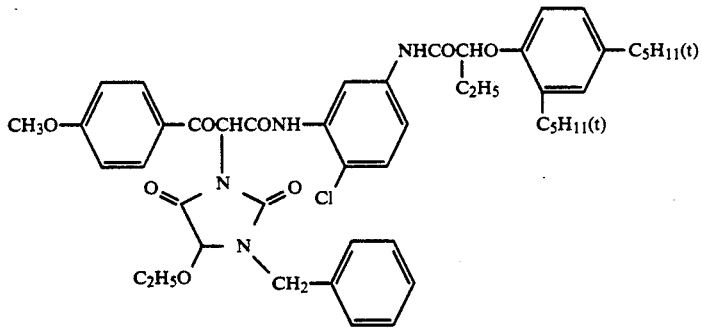

(coupler used in JP-A-55-161238) R-3

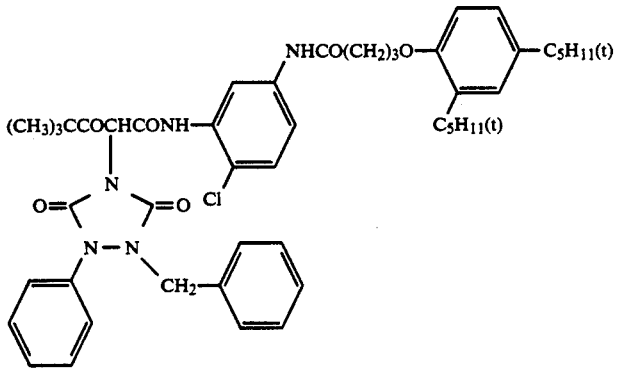

(coupler used in JP-A-55-161238) R-4

-continued
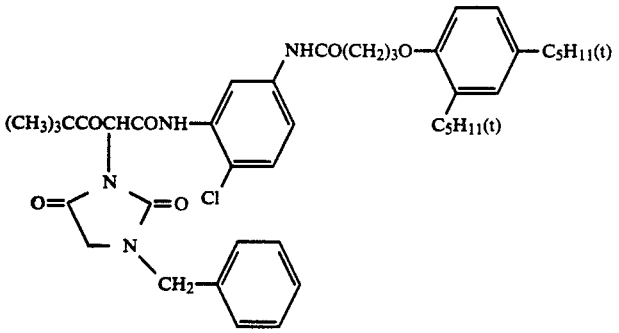
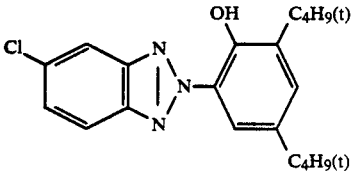
U-1
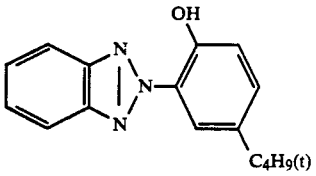
U-2
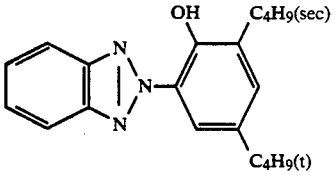
U-3
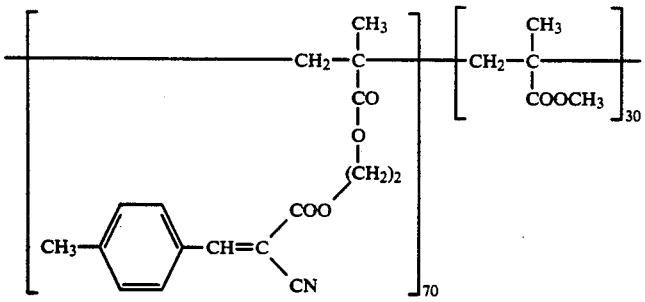
U-4
70:30 is of weight ratio. Mean Molecular Weight = about 25,000
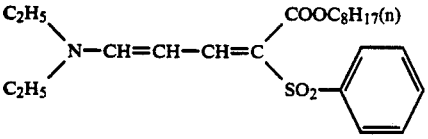
U-5

-continued
EX-1
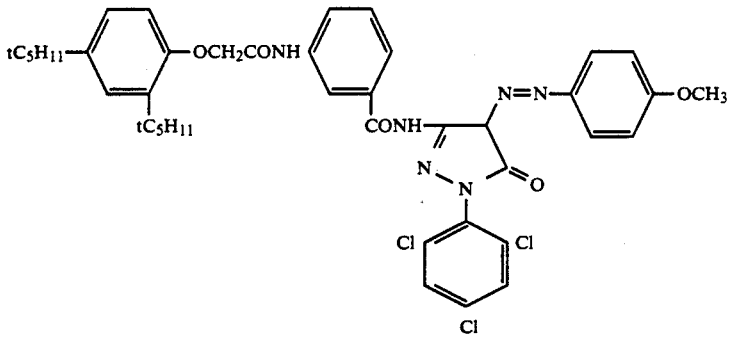
EX-2
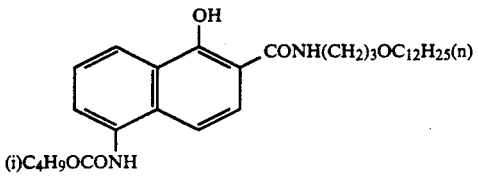
EX-3
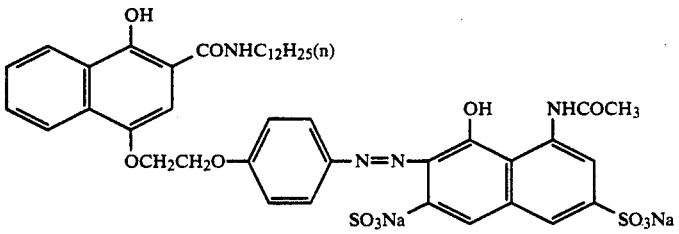
EX-4
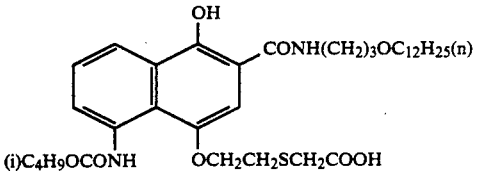
EX-5
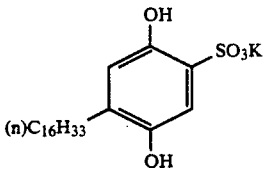
EX-6
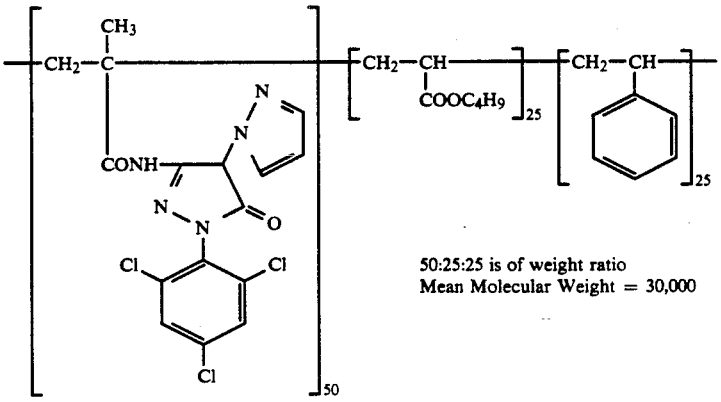
50:25:25 is of weight ratio
Mean Molecular Weight = 30,000

-continued
EX-7
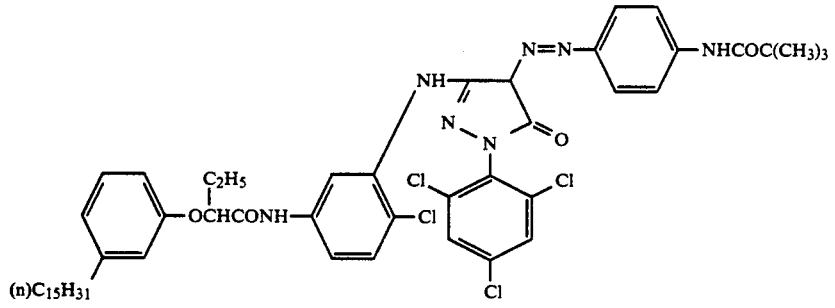
EX-8
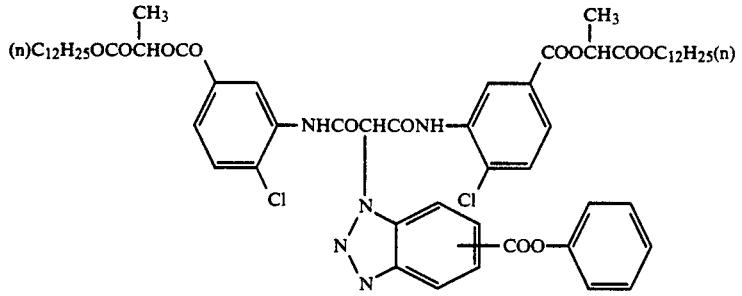
EX-9
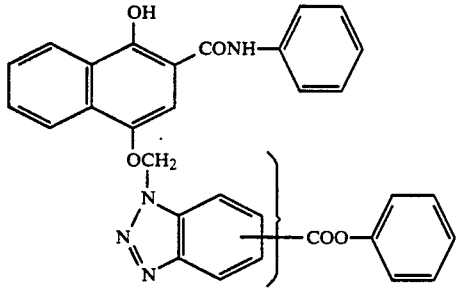
EX-10
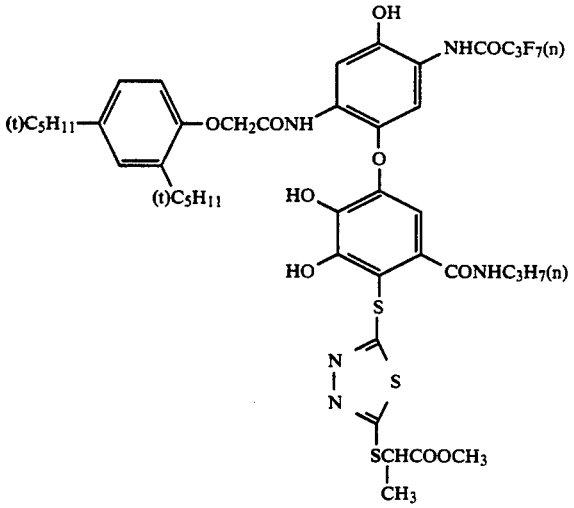

-continued
EX-11
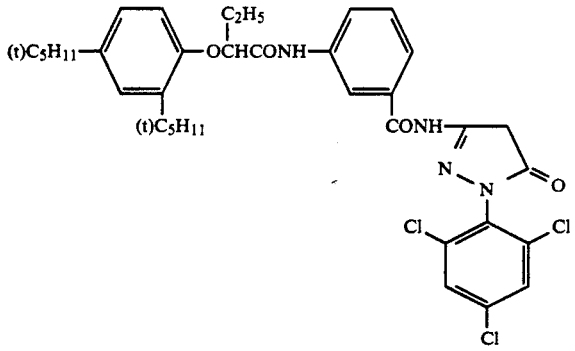
EX-12
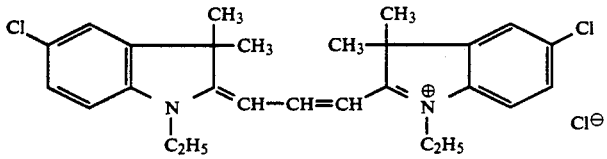
EX-13
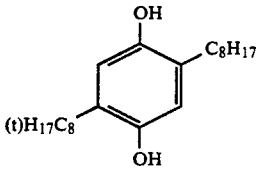
S-1
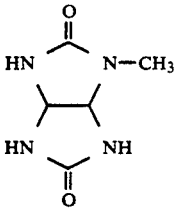
S-2
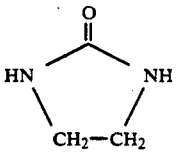
HBS-1 Tricresyl phosphate
HBS-2 Dibutyl phthalate
HBS-3 Bis(2-ethylhexyl) phthalate
HBS-4
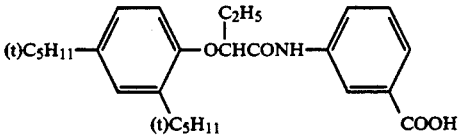
H-1
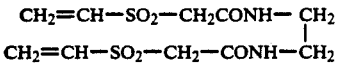
Sensitizing Dye
I
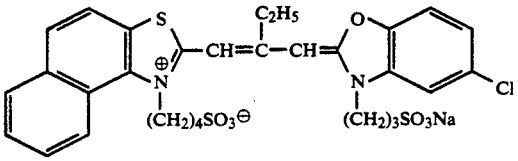

-continued

II

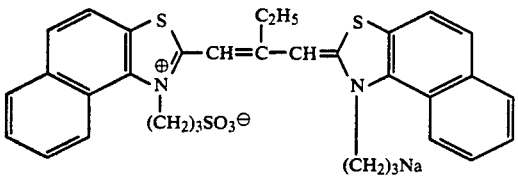

III

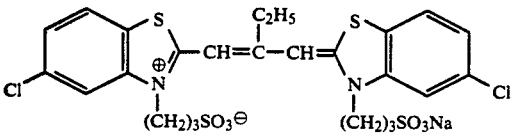

IV

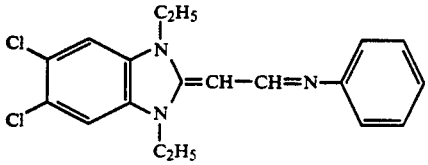

V

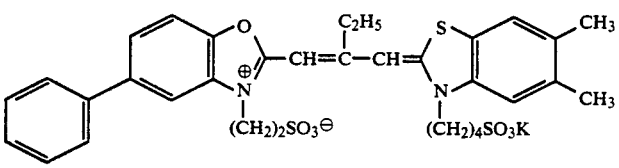

VI

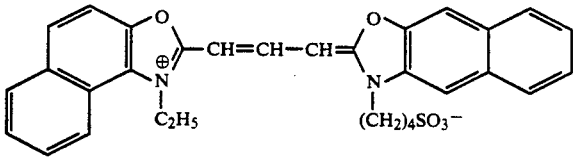

VII

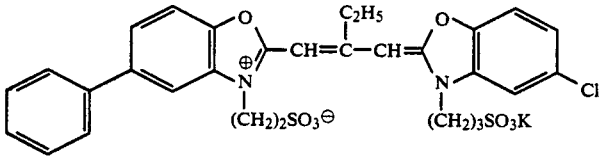

VIII

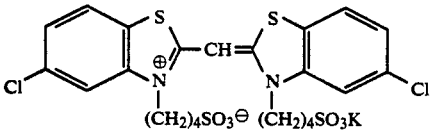

IX

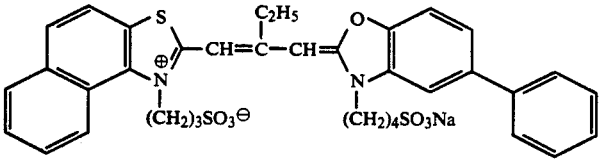

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein the silver halide color photographic material contains oil droplets, at least one water-insoluble and organic solvent soluble homopolymer or copolymer which is dispersed in gelatin, said homopolymer or copolymer being composed of a repeating unit having a group of $$-\underset{\underset{O}{\|}}{C}-\underset{\underset{R^{II}}{|}}{N}-R^{I}$$

in its side chain wherein $R^{I}$ and $R^{II}$, which may be the same or different, each represents a hydrogen atom, a substituted or unsubstituted alkyl group or a substituted or unsubstituted aryl group and at least one yellow coupler which is dispersed in an organic solvent in a gelatin binder layer and which is represented by formula (I):

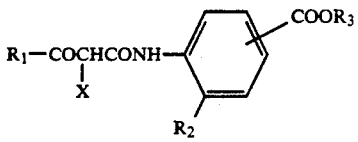

(I)

wherein $R_1$ represents a tertiary alkyl group or an aryl group; $R_2$ represents a hydrogen atom, a halogen atom or an alkoxy group; $R_3$ represents an alkyl group or an aryl group; X represents a group capable of being released upon a coupling reaction with an oxidation product of an aromatic primary amine developing agent, and wherein the polymer is present in a light-insensitive layer adjacent to a light-sensitive silver halide emulsion layer containing the yellow coupler.

2. A silver halide color photographic material as claimed in claim 1, wherein $R_1$ represents a tertiary alkyl group having from 4 to 30 carbon atoms which may be substituted or an aryl group having from 6 to 30 carbon atoms which may be substituted.

3. A silver halide color photographic material as claimed in claim 2, wherein a substituent for the tertiary alkyl group is selected from a halogen atom, an alkoxy group, an aryloxy group, an alkylthio group, an arylthio group, a sulfonyl group, a sulfinyl group, a cyano group, a thiocyanato group, a hydroxy group, an imido group and a heterocyclic group.

4. A silver halide color photographic material as claimed in claim 2, wherein a substituent for the aryl group is selected from a halogen atom, an alkyl group, an alkoxy group, a nitro group, an amino group, a carbonamido group and a sulfonamido group.

5. A silver halide color photographic material as claimed in claim 1, wherein $R_2$ represents a hydrogen atom, a halogen atom or an alkoxy group having from 1 to 30 carbon atoms which may be substituted.

6. A silver halide color photographic material as claimed in claim 5, wherein a substituent for the alkoxy group is selected from a halogen atom and an alkoxy group.

7. A silver halide color photographic material as claimed in claim 1, wherein $R_3$ represents an alkyl group having from 1 to 30 carbon atoms which may be substituted or an aryl group having from 6 to 30 carbon atoms which may be substituted.

8. A silver halide color photographic material as claimed in claim 7, wherein a substituent for the alkyl group is selected from a halogen atom, a cyano group, a nitro group, an aryl group, an alkoxy group, an alkoxycarbonyl group, a carbamoyl group, an aryloxy group, an alkylthio group, an arylthio group, a sulfonyl group, a sulfinyl group and a heterocyclic group.

9. A silver halide color photographic material as claimed in claim 7, wherein a substituent for the aryl group is selected from a halogen atom, an alkyl group, an aryl group, an alkoxy group and an alkoxycarbonyl group.

10. A silver halide color photographic material as claimed in claim 1, wherein X represents a halogen atom, a sulfonyloxy group having from 1 to 30 carbon atoms, an acyloxy group having from 2 to 30 carbon atoms, an alkoxycarbonyloxy group having from 2 to 30 carbon atoms, a carbamoyloxy group having from 1 to 30 carbon atoms, an alkylthio carbonyloxy group,having from 2 to 30 carbon atoms, a heterocyclic oxy group having from 1 to 30 carbon atoms, a phenoxy group having from 6 to 30 carbon atoms which may be substituted and a heterocyclic group having from 1 to 30 carbon atoms which is connected to the coupling active position by the nitrogen atom included therein and which may be substituted.

11. A silver halide color photographic material as claimed in claim 10, wherein a substituent for the phenoxy group represented by X is selected from a halogen atom, a hydroxyl group, a nitro group, a cyano group, a carboxyl group, a sulfo group, a carboxylato group, a sulfonato group, a sulfinato group, an alkyl group, an alkoxy group, an acyl group, an alkoxycarbonyl group, a carbamoyl group, a sulfonyl group, a sulfamoyl group, a carbonamido group and an amino group.

12. A silver halide color photographic material as claimed in claim 10, wherein a substituent for the heterocyclic group represented by X is selected from a halogen atom a hydroxyl group, a nitro group, a cyano group, a carboxyl group, a sulfo group, a carboxylato group, a sulfonato group, a sulfinato group, an alkyl group, an alkoxy group, an acyl group, an alkoxycarbonyl group, a carbamoyl group, a sulfonyl group, a sulfamoyl group, a carbonamido group and an amino group.

13. A silver halide color photographic material as claimed in claim 1, wherein $R_1$ is a tertiary butyl group, a phenyl group, or a phenyl group substituted with a chlorine atom, a methyl group or a methoxy group.

14. A silver halide color photographic material as claimed in claim 1, wherein $R_2$ is a chlorine atom, or an alkoxy group having from 1 to 8 carbon atoms.

15. A silver halide color photographic material as claimed in claim 1, wherein $R_3$ is an alkyl group having from 6 to 24 carbon atoms.

16. A silver halide color photographic material as claimed in claim 1, wherein $R_3$ is an alkyl group which is substituted with a substituent selected from an alkoxycarbonyl group or an alkoxy group.

17. A silver halide color photographic material as claimed in claim 1, wherein the $—COOR_3$ group is present at the para position to $R_2$.

18. A silver halide color photographic material as claimed in claim 1, wherein the alkyl group represented by $R^I$ or $R^{II}$ is an alkyl group having from 1 to 18 carbon atoms.

19. A silver halide color photographic material as claimed in claim 1, wherein the alkyl group is an alkyl group having from 1 to 6 carbon atoms.

20. A silver halide color photographic material as claimed in claim 1, wherein the aryl group represented by $R^I$ or $R^{II}$ is a phenyl group or a naphthyl group.

21. A silver halide color photographic material as claimed in claim 1, wherein a substituent for the alkyl group or aryl group is selected from a halogen atom, a nitro group, a cyano group, a hydroxy group, a carboxy group, a sulfo group, a mercapto group, an alkoxy group, an alkylthio group, an arylthio group, an alkylsulfonyl group, an arylsulfonyl group, a carbonamido group, a sulfonamido group, an amino group, a carbamoyl group, an alkoxycarbonyl group, an aryloxycarbonyl group, an acyloxy group, a sulfamoyl group, an acyl group, an imido group, a ureido group, an alkoxycarbonylamino group, an aryl group and a heterocyclic group.

22. A silver halide color photographic material as claimed in claim 1, wherein the molecular weight of the polymer is from 2,000 to 1,000,000.

* * * * *